US011029078B2

(12) United States Patent
Lee et al.

(10) Patent No.: US 11,029,078 B2
(45) Date of Patent: Jun. 8, 2021

(54) REFRIGERATOR

(71) Applicant: LG ELECTRONICS INC., Seoul (KR)

(72) Inventors: Heejun Lee, Seoul (KR); Seungyoon Cho, Seoul (KR); Dongjeong Kim, Seoul (KR); Seunguk Ahn, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 16/347,377

(22) PCT Filed: Nov. 3, 2017

(86) PCT No.: PCT/KR2017/012449
§ 371 (c)(1),
(2) Date: May 3, 2019

(87) PCT Pub. No.: WO2018/084657
PCT Pub. Date: May 11, 2018

(65) Prior Publication Data

US 2020/0263918 A1 Aug. 20, 2020

(30) Foreign Application Priority Data

Nov. 3, 2016 (KR) ..... 10-2016-0145995

(51) Int. Cl.
*F25D 23/02* (2006.01)
*E05F 15/619* (2015.01)
(Continued)

(52) U.S. Cl.
CPC ..... *F25D 23/028* (2013.01); *E05F 5/12* (2013.01); *E05F 15/619* (2015.01);
(Continued)

(58) Field of Classification Search
CPC .. F25D 23/028; F25D 29/00; F25D 2323/021; E05F 15/619; E05Y 2201/426;
(Continued)

(56) References Cited

U.S. PATENT DOCUMENTS 10,301,865 B2 * 5/2019 Son ..... E05F 15/75
2016/0242542 A1 * 8/2016 Friesenecker ..... A47B 88/457

FOREIGN PATENT DOCUMENTS

JP 2014214893 A * 11/2014
JP 2015-055130 3/2015
(Continued)

OTHER PUBLICATIONS

Translated Description JP2015055130A, 36 pages (Year: 2015).*
(Continued)

*Primary Examiner* — Andrew M Roersma
(74) *Attorney, Agent, or Firm* — Fish & Richardson P.C.

(57) ABSTRACT

The present invention relates to a refrigerator that allows a user to easily open a door thereof. A refrigerator, according to one embodiment of the present invention, may comprise: a cabinet having a storage compartment; left and right doors for opening and closing the storage compartment from the left and right; a door opening module provided to open the left and right doors; and having a single motor provided to rotate forward and backward; and a control unit for controlling forward and backward driving of the single motor, wherein the door opening module comprises: left and right racks provided to be moved by driving of the single motor so as to respectively open the left and right doors; a power transmission device for selectively transmitting a driving force of the single motor to the left and 4right racks; and a single switch provided to be turned on/off in conjunction with the power transmission device, and wherein the control unit detects a current position of the left and right racks
(Continued)

through the switching-on/off of the single switch, and controls the forward and backward driving and stopping of the single motor.

17 Claims, 24 Drawing Sheets

(51) Int. Cl.
*E05F 5/12* (2006.01)
*E05F 17/00* (2006.01)
*F25D 29/00* (2006.01)

(52) U.S. Cl.
CPC ..... *E05F 17/004* (2013.01); *F25D 29/00* (2013.01); *E05Y 2201/426* (2013.01); *E05Y 2201/434* (2013.01); *E05Y 2201/618* (2013.01); *E05Y 2201/716* (2013.01); *E05Y 2201/722* (2013.01); *E05Y 2800/21* (2013.01); *E05Y 2900/31* (2013.01); *F25D 2323/021* (2013.01)

(58) Field of Classification Search
CPC ..... E05Y 2201/716; E05Y 2201/722; E05Y 2900/31
See application file for complete search history.

(56) References Cited

FOREIGN PATENT DOCUMENTS

| | | | | | |
|---|---|---|---|---|---|
| JP | 2015-068573 | | | 4/2015 | |
| JP | 2015-105765 | | | 6/2015 | |
| JP | 2015117893 | | | 6/2015 | |
| JP | 2015117897 | | | 6/2015 | |
| JP | 2015-135220 | | | 7/2015 | |
| JP | 2016109396 | A | * | 6/2016 | ..... F25D 23/028 |
| KR | 10-2016-0029514 | | | 3/2016 | |
| WO | WO2016036212 | | | 3/2016 | |

OTHER PUBLICATIONS

Translated Description JP2015068573A, 32 pages (Year: 2015).*
Translated Description JP2015105765A, 17 pages (Year: 2015).*
Translated Description JP2015135220A, 54 pages (Year: 2015).*
Extended European Search Report in European Appln. No. 17866422.3, dated May 11, 2020, 8 pages.

* cited by examiner

REFRIGERATOR

CROSS-REFERENCE TO RELATED APPLICATIONS

This application is a National Stage application under 35 U.S.C. § 371 of International Application No. PCT/KR2017/012449, filed on Nov. 3, 2017, which claims the benefit of Korean Patent Application No. 10-2016-0145995, filed on Nov. 3, 2016. The disclosures of the prior applications are incorporated by reference in their entirety.

TECHNICAL FIELD

The present invention relates to a refrigerator, and particularly, to a refrigerator allowing a user to easily open a door of the refrigerator.

BACKGROUND ART

A refrigerator is a household appliance which stores objects such as food at low temperatures in a storage compartment provided in a cabinet. The storage compartment is enclosed by a heat insulating wall so that the inside of the storage compartment is maintained at a temperature lower than an external temperature. The storage compartment may be referred to as a refrigerating chamber or a freezing chamber according to temperature zones of the storage compartment.

A user opens and closes the storage compartment through a door. The user opens the door to put an object into or out of the storage compartment. Generally, the door is rotatably provided in the cabinet, and a gasket is provided between the door and the cabinet. Accordingly, when the door is closed, the gasket is brought into close contact with the door and the cabinet, thereby preventing cold air from leaking from the storage compartment. As adhesion of the gasket increases, the effect of preventing cold air leakage may increase.

In order to increase adhesion of the gasket, the gasket may be formed of a rubber magnet, and a magnet may be provided in the gasket. However, when adhesion of the gasket increases, it means that a large force is required to open the door.

Recently, a refrigerator having auto-closing function is provided. The auto closing function refers to a function of automatically closing the door of the refrigerator when the door of the refrigerator is slightly opened, using adhesion and a magnetic force of the gasket and an elastic force by a spring. In addition, the auto-closing function refers to that the door of the refrigerator is not opened automatically even when the refrigerator is slightly inclined forwards.

Accordingly, the recently provided refrigerator requires a lot of force to open the door as compared with previous refrigerators. This is because, in order to open the door of the refrigerator, it is necessary to overcome the adhesion and the magnetic force of the gasket and the elastic force.

For example, the user may need a force of 6 kgf to open the door of the refrigerator. This force is relatively large, which makes it impossible to open the door easily. Also, if a very large force is applied to open the door, the door may be opened suddenly.

In order to solve such a problem, Japanese Patent Laid-Open Publication No. JP2015-55130A (hereinafter referred to as "prior art invention") discloses a door opening device for automatically opening a door by pushing the door by a rack.

In the above-described prior art invention, a rotary gear engaged with a rack gear rotates to generate a linear motion which increases a speed and decreases a force. That is, when the rack linearly moves, the speed increases linearly and the force decreases.

Therefore, the force decreases before the rack reaches the door at an initial stage where the rack is drawn out, reducing efficiency when the door is opened. This is because there is a gap between the rack which is drawn in and the door. That is, due to the gap, no-load movement of the rack occurs in a predetermined interval until the rack is drawn out to reach the door.

Therefore, in the prior art invention, the force is reduced by the predetermined interval, and thus, the force for opening the door at the initial stage is inevitably reduced.

Further, if a gear ratio is increased to maintain the force until the rack reaches the door beyond the predetermined interval, the overall speed decreases to reduce an opening angle of the door.

In order to open right and left doors through left and right racks by driving a single motor, current positions or a state of the left and right racks must be recognized. That is, it is necessary to recognize whether each of the left and right doors is open and to recognize an initial position where both left and right racks are drawn in.

In the prior art invention, two switches are used therefor. For example, at an initial position (both left and right doors are closed), a left switch is turned off and a right switch is turned on, and in a state that the left rack is drawn out (only the left door is opened), the left switch is turned off and the right switch is turned on. In a state that the right rack is drawn out (left door is opened and the right door is subsequently opened), the left switch is turned on and the right switch is turned off. Also, in a state that any one of the racks is drawn out and driving of a motor is stopped, the left switch is turned on and the right switch is turned on.

Therefore, since two switches are supposed to be used, the structure of a door opening module is complicated, and since the two switches are frequently switched, a service life of the switches may be shortened, degrading reliability of the door opening module.

DISCLOSURE

Technical Problem

The present invention basically aims at solving the problems of the conventional refrigerator and the problems of the prior art invention described above.

According to an embodiment of the present invention, there is provided a refrigerator in which an angle at which a door is automatically opened is increased to increase user convenience.

According to an embodiment of the present invention, there are provided a door opening module which easily changes a configuration of a conventional door opening module and effectively implemented, and a refrigerator including the same.

According to an embodiment of the present invention, there is provided a refrigerator in which a speed and a force of a rack drawn from a door opening module is maintained until it starts to open a door. Accordingly, a refrigerator in which an automatic opening angle of the door is increased may be provided.

According to an embodiment of the present invention, there is provided a refrigerator in which an opening speed increases as an angle at which a door is automatically opened increases. Accordingly, a refrigerator in which the door may be opened more inertially by the opening acceleration of the door.

According to an embodiment of the present invention, there is provided a refrigerator in which an angle at which a door is automatically opened is increased by maintaining a magnitude of force for initial opening of the door.

According to an embodiment of the present invention, there is provided a refrigerator in which a left door and a right door are sequentially opened by applying a single switch, and a control method thereof.

According to an embodiment of the present invention, there is provided a refrigerator in which an initial position where both left and right racks are drawn in is effectively recognized by applying a single switch, and a control method thereof.

According to an embodiment of the present invention, there is provided a refrigerator in which the number of switches is reduced, thus reducing manufacturing cost by minimizing the number of components, and switching frequency is reduced, thus increasing reliability of the switches and reliability of a door opening module.

Technical Solution

To solve the technical problem as described above, there is provided a refrigerator according to the present invention including: a cabinet having a storage compartment; left and right doors configured to open and close the storage compartment from left and right; a door opening module configured to open the left and right doors and having a single motor provided to rotate forwards and backwards; and a controller configured to control forward and reverse driving of the single motor, wherein the door opening module includes: left and right racks configured to move according to driving of the single motor to open the left and right doors, respectively; a power transfer device configured to selectively transfer a driving force from the single motor to the left and right racks; and a single switch turned on/off in conjunction with the power transfer device, wherein the controller controls forward and reverse driving and stopping of the single motor by recognizing a current position of the left and right racks through ON/OFF of the single switch.

The power transfer device may include: a central gear configured to rotate according to driving of the motor; and left and right intermittent gears selectively engaged with the central gear, the left and right intermittent gears being disposed at left and right sides of the central gear.

At an initial position where both the left and right racks are drawn in, the central gear may be engaged with the right intermittent gear when rotate in one direction and engaged with the left intermittent gear when rotate in another direction.

At the initial position where both the left and right racks are drawn in, the central gear may be engaged with the right intermittent gear and may not be engaged with the left intermittent gear in a rotation interval of less than 180° in a clockwise direction of the central gear.

At the initial position where both the left and right racks are drawn in, the central gear may be engaged with the left intermittent gear and may not be engaged with the right intermittent gear in a rotation interval of less than 180° in a counterclockwise direction of the central gear.

The power transfer device may include a horizontally asymmetrical cam configured to rotate with respect to the same rotation center as a rotation center of the central gear, and the single switch is turned on/off according to displacement varied by the asymmetrical cam.

At the initial position where both the left and right racks are drawn in, left and right shapes of the cam may be different with respect to a cam initial position where the cam and the switch are in contact with each other.

The cam may be formed to be inversion-symmetrical at the cam initial position.

The cam may have an ON interval, an OFF interval, and the ON interval of the switch from the cam initial position to a position corresponding to 180° in the clockwise direction, and the cam may have the OFF interval, the ON interval, and the OFF interval of the switch from the cam initial position to a position corresponding to 180° in the counterclockwise direction.

The controller may control driving of the single motor by recognizing a current position of the left and right racks through a change in ON/OFF of the single switch.

The controller may control driving of the single motor such that the left and right racks sequentially move.

The controller may control driving of the single motor such that any one of the left and right racks is drawn out and returned, and thereafter, the other is drawn out and returned.

The power transfer device may divide the driving force from the single motor into a constant speed interval and an accelerated speed interval and transfer the divided interval to the left and right racks.

The constant speed interval may be an interval during which the left and right racks move at a constant speed at an initial stage when the left and right racks are drawn out, and the accelerated speed interval may be an interval during which a speed for drawing out the left and right racks increases after the constant speed interval.

A force for opening the door at the constant speed interval may be constant and a force for opening the door at the accelerated speed interval may decrease.

The power transfer device may include a reduction gear and rack gear provided in the rack and engaged with the reduction gear.

The reduction gear may include a plurality of constant speed gear teeth having a predetermined radius from a rotation center and a plurality of acceleration gear teeth having a radius gradually increased at the rotation center, and the rack gear includes a plurality of linear gear teeth engaged with the constant speed teeth and a plurality of diagonal gear teeth engaged with the accelerated gear teeth.

To solve the technical problem as described above, there is provided a refrigerator including: a cabinet having a storage compartment; left and right doors configured to open and close the storage compartment from left and right; a single motor configured to rotate forwards and backwards; a central gear configured to rotate according to driving of the single motor; a cam provided at the central gear and configured to be horizontally inversion-symmetrical; a single switch turned on/off according to a height of the cam; left and right racks configured to move according to rotation of the central gear to open and close the left and right doors, respectively; and a controller configured to control forward and reverse driving of the single motor by recognizing a current position of the left and right racks through ON/OFF of the single switch.

The controller may control forward and reverse driving of the single motor such that the central gear rotates by one turn or less through a change in ON/OFF of the single switch.

At an initial position where both the left and right racks are drawn in, the cam may be formed to be inversion-symmetrical with respect to a cam initial position where the cam and the switch are in contact with each other.

The cam may have an ON interval, an OFF interval, and the ON interval of the switch from the cam initial position to a position corresponding to 180° in the clockwise direction, and the cam may have the OFF interval, the ON interval, and the OFF interval of the switch from the cam initial position to a position corresponding to 180° in the counterclockwise direction.

The controller may control forward and reverse driving of the single motor by recognizing a current position of the left and right racks through a change in ON/OFF of the single switch.

When power is applied to the refrigerator in a state that at least any one of the left and right doors is open, the controller may control forward and reverse driving of the single motor such that the left and right racks are at an initial position where both the left and right racks are drawn in through a change in ON/OFF of the single switch.

When an input for opening the left and right doors is applied in a state that both the left and right doors are closed, the controller may control the single motor to be driven forwards and subsequently driven backwards such that any one of the left and right racks is drawn out and subsequently drawn in, and thereafter, the controller controls the single motor to be driven backwards and subsequently driven forwards such that the other of the left and right racks is drawn out and subsequently drawn in.

Advantageous Effect

According to an embodiment of the present invention, it is possible to provide a refrigerator which may increase user convenience by increasing an angle at which the door is opened.

According to an embodiment of the present invention, it is possible to provide a door opening module which may easily change a configuration of the conventional door opening module and may be effectively implemented, and a refrigerator including the same.

According to an embodiment of the present invention, it is possible to provide a refrigerator capable of maintaining a speed and a force until a rack drawn out from a door opening module starts to open the door. Accordingly, it is possible to provide a refrigerator capable of increasing an automatic opening angle of the door.

According to an embodiment of the present invention, it is possible to provide a refrigerator in which an opening speed increases as an angle at which the door is automatically opened increases. Therefore, it is possible to provide a refrigerator in which the door may be opened more inertially by opening acceleration of the door.

According to an embodiment of the present invention, it is possible to provide a refrigerator in which an angle at which the door is automatically opened may be increased by maintaining a magnitude of force for initial opening of the door.

According to an embodiment of the present invention, it is possible to provide a refrigerator in which the left door and the right door may be sequentially by applying a single switch, and a control method thereof.

According to an embodiment of the present invention, it is possible to provide a refrigerator in which an initial position where both the left and right racks are drawn in may be effectively recognized by applying a single switch, and a control method thereof.

According to an embodiment of the present invention, it is possible to provide a refrigerator in which the number of switches is reduced, thus reducing manufacturing cost by minimizing the number of components, and switching frequency is reduced, thus increasing reliability of the switches and reliability of a door opening module.

MODE FOR INVENTION

Hereinafter, exemplary embodiments of the present invention will be described in detail with reference to the accompanying drawings.

Figure 1:
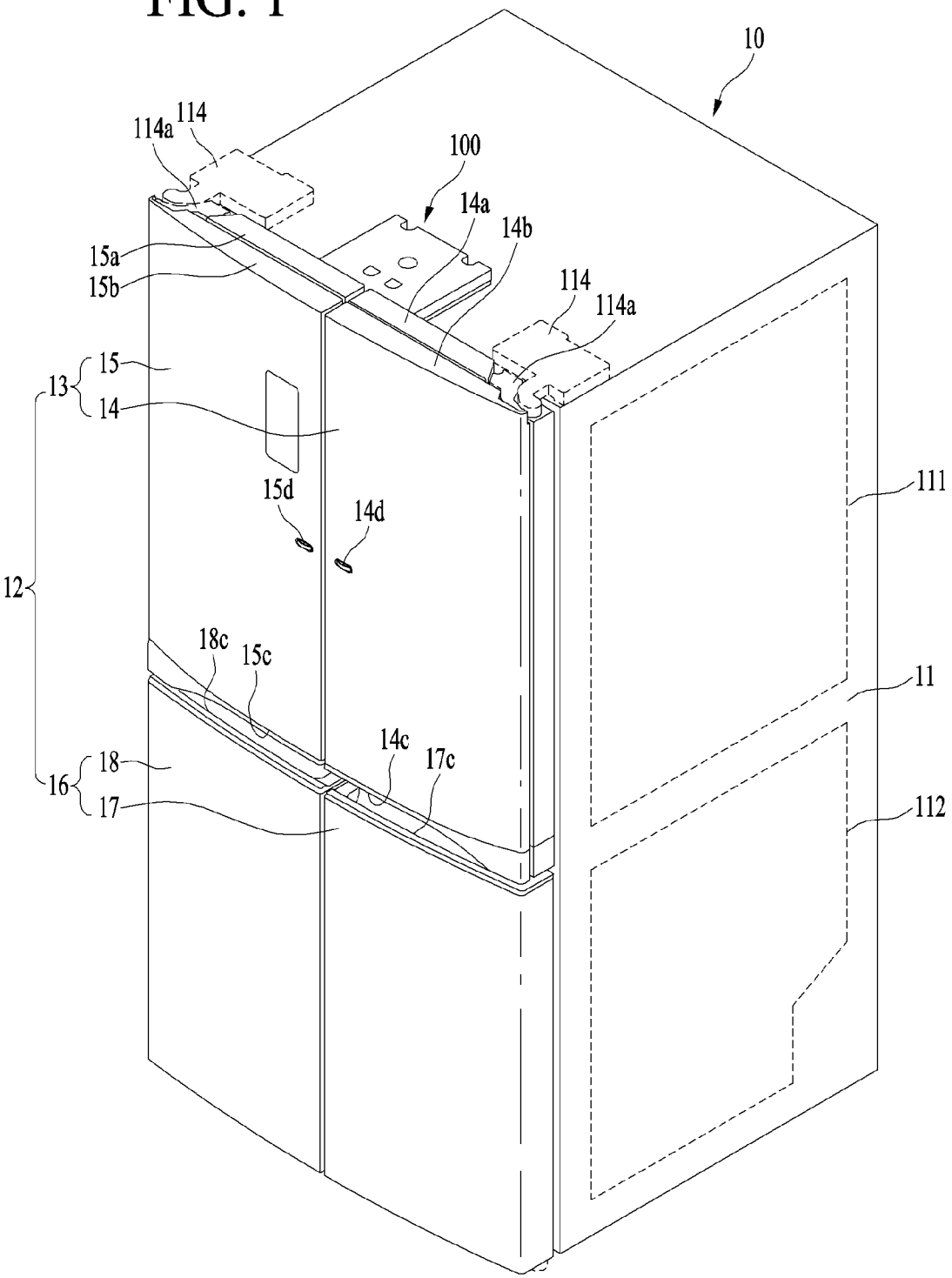
FIG. 1 illustrates a configuration of a refrigerator according to an embodiment of the present invention.

FIG. 1 is a perspective view of a refrigerator according to an embodiment of the present invention. For example, a refrigerator including two doors for opening and closing an upper refrigerating chamber 111 and two doors for opening and closing a lower freezing chamber 112 is illustrated. The upper refrigerating chamber 111 and the lower freezing chamber 112 are vertically partitioned by a partition 11.

The refrigerator according to an embodiment of the present invention may include a cabinet 10 having a storage compartment and a door 12 provided in the cabinet 10. The storage compartment formed by the cabinet may be opened and closed through the door 12. Accordingly, an appearance of the refrigerator may be formed by the cabinet 10 and the door 12.

Since a user uses the refrigerator in front of the refrigerator, the door is located on a front side of the refrigerator.

For example, a refrigerator chamber door 13 for opening and closing the refrigerating chamber 111 may be provided. The refrigerator chamber door 13 may include left and right doors 15 and 14. Further, a freezing chamber door 16 for opening and closing the freezing chamber 112 may be provided. The freezing chamber door 16 may include left and right doors 18 and 17.

The door 12 may be rotatable through a door hinge 114. That is, the door 12 may be provided to be rotatable with respect to the cabinet through the door hinge 114.

The user holds the door 12 to open and close the door. To this end, the door is provided with a handle. FIG. 1 illustrates an example in which the doors 14, 15, 17, and 18 are provided with handles 14*c*, 15*c*, 17*c*, and 18*c*, respectively.

The illustrated refrigerator is an example of a double-door refrigerator. The refrigerating chamber door 13 for opening and closing the storage compartment is a dual-door. For example, the right refrigerating chamber door 14 may include a main door 14*a* and a sub door 14*b*.

When the main door 14*a* and the sub door 14*b* are opened together by holding the handle 14*c*, the refrigerating chamber 111 may be accessed. When only the sub door 14*b* is opened, the user may access a sub-storage compartment formed in the main door 14*a*.

A door button 14*d* may be provided to open the sub door 14*b*. The sub door may be rotatably provided in the main door 14 through the sub hinge 114*a*.

Like the right door 14, the left door 15 may also be formed as a dual door. Accordingly, the left door 15 may include a main door 15*a*, a sub door 15*b*, and a door button 15*d*.

The refrigerator according to the present embodiment includes a door opening module 100 for automatically opening the left door 15 and the right door 14. The door opening module 100 is located at an upper portion of the cabinet 100 and may push upper portions of the left door 15 and the right door 14 to automatically open them. The refrigerator may automatically open the door by recognizing user's intention to open the door through a sensor or an input unit (not shown).

Figure 2:
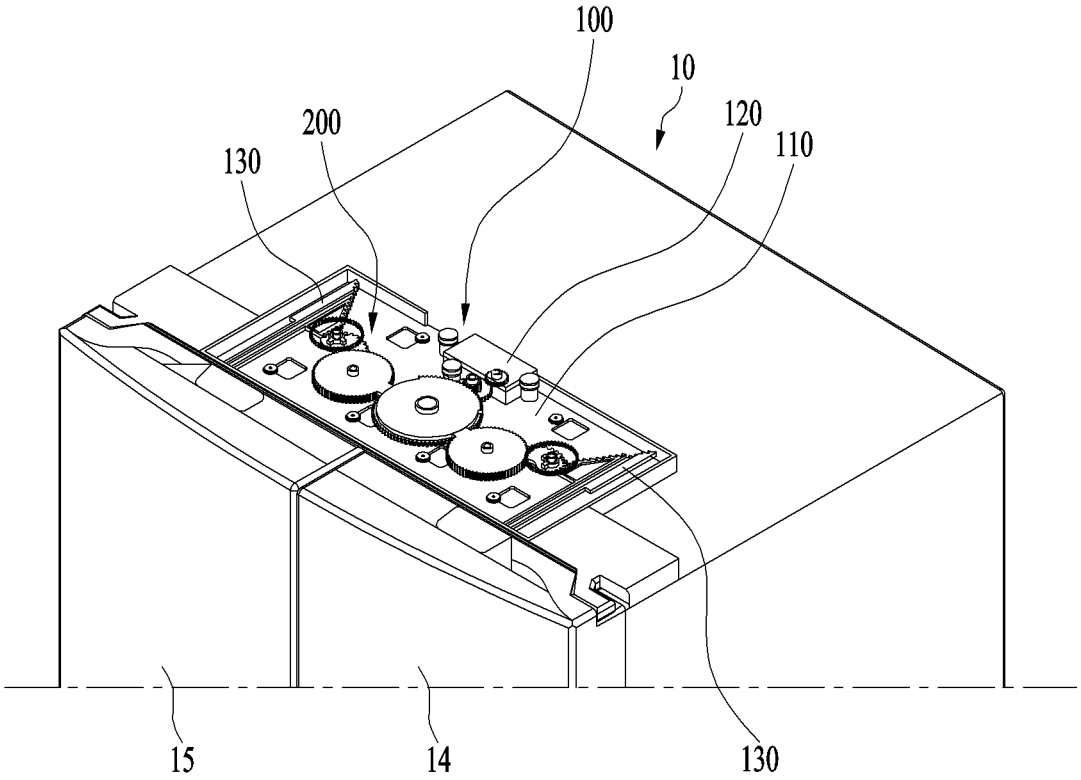
FIG. 2 illustrates an interior of a door opening module in a refrigerator equipped with the door opening module according to an embodiment of the present invention.

FIG. 2 is an internal view of the door opening module 100 mounted at an upper portion of a cabinet 10 of the refrigerator.

The door opening module 100 includes a housing 110 and the door opening module 100 may be mounted in the cabinet as the housing 110 mounted in the cabinet 10.

A motor assembly 120, the power transmission device 200, and left and right racks 130 may be provided in the housing 110. The left and right racks 130 may be drawn and out according to driving of the motor assembly 120 and transmission of a driving force through the power transmission device 200.

The left door 15 may be opened as the left rack is drawn out, and the right door 14 may be opened as the right rack is drawn out.

The door opening module 100 according to an embodiment of the present invention will be described in detail with reference to FIGS. 3 to 5.

The motor assembly 120 for generating a driving force may be received in the housing 110 of the door opening module 100. The motor assembly 120 includes a motor housing 122 that receives a motor 121. Driving of the motor 121 may be transmitted to the outside through a worm gear 180.

The motor housing may be mounted through an anti-vibration member 125.

A driving force of the motor 121 is finally switched to an operation of the left and right racks 130. Therefore, a power transmission device 200 is provided between the motor and the left and right racks 130. The worm gear 180 may be a component of the power transmission device 200.

The power transmission device 200 may include a central gear 150. A connection gear 170 may be provided between the central gear 150 and the worm gear 180. The central gear 150 may also be rotated in forward and reverse directions according to forward and reverse directions of the motor 121.

The power transmission device 200 may be horizontally symmetrical with respect to the central gear 150. For example, when the central gear 150 operates, if only the right components of the central gear 150 operate, the right rack 130 may be drawn out and drawn in. Also, when only the left components of the central gear 150 operate, the left rack 130 may be drawn out and drawn in.

Thus, according to the present embodiment, both the left and right racks may be operated through a single motor or a motor assembly.

The left and right racks 130 may be sequentially driven. For example, after the left rack may be drawn out and subsequently drawn in, the right rack may be drawn out and subsequently drawn in, or vice versa.

The left rack may be drawn out by forwardly driving the motor and the left rack may be drawn in by reversely driving the motor. Also, the right rack may be drawn out by reversely driving the motor and the right rack may be drawn in by forwardly driving the motor.

Therefore, in the forward driving of the motor, the left rack is drawn out and the right rack is drawn in, and in the reverse driving of the motor, the left rack is drawn in and the right rack is drawn out. However, drawing-out of the left rack and drawing-in of the right rack do not simultaneously occur. Of course, drawing-in of the left rack nor drawing-out of the right rack do not simultaneously occur.

A controller of the refrigerator controls driving of the motor by recognizing a current state of the door opening module. That is, the controller recognizes which of the racks moves and how it moves according to the current forward driving and reverse driving of the motor. Details thereof will be described later.

By the forward and reverse driving of the motor, the central gear is also driven in forward and reverse directions. Intermittent gears 160 are provided on the left and right sides of the central gear 150, respectively. Only one of the left and right intermittent gears 160 may be driven according to driving of the central gear.

For example, when the central gear rotates by 180 degrees in a counterclockwise direction, the right intermittent gear 160 rotates by 180 degrees in a clockwise direction to draw out the right rack 130. When the central gear rotates by 180 degrees in the clockwise direction, the right intermittent gear 160 rotates by 180 degrees in the counterclockwise direction to draw in the right rack 130.

When the drawing-out and drawing-in of the right rack is terminated, the central gear 150 may further rotate by 180 degrees in the counterclockwise direction. Here, the left intermittent gear 160 may rotate in the clockwise direction to draw in the left rack 130. When the central gear 150 rotates by 180 degrees in the clockwise direction, the left intermittent gear 160 may rotate in the counterclockwise direction to draw in the right rack 130.

Figure 3:
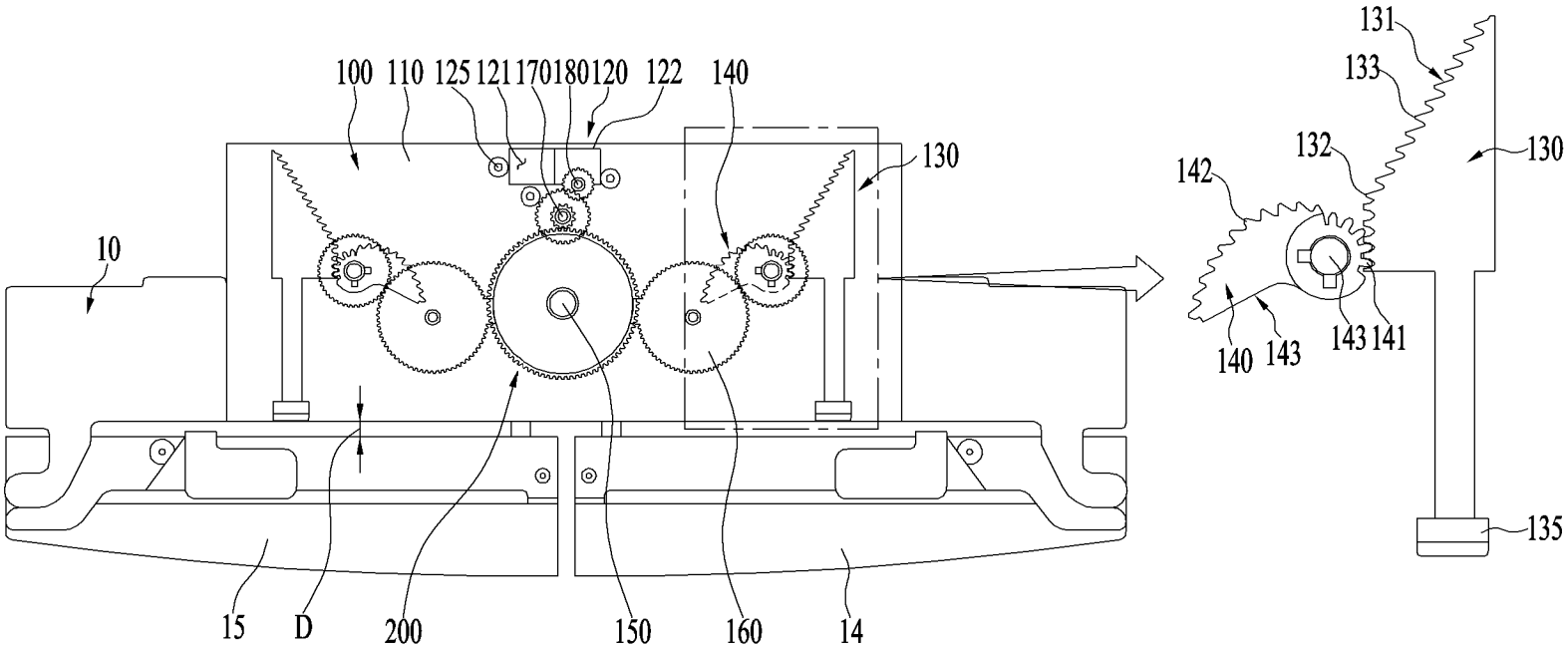
FIG. 3 is a view illustrating a configuration between a door and a door opening module in an embodiment of the present invention.

As illustrated in FIG. 3, a gap D is formed between a rack cover 135 and the doors 14 and 15 in a state in which the rack 130 is drawn in. The gap D may be generated by a gasket between the door and the cabinet. This gap may be about 9 mm.

A largest amount of force is required to open the door at an initial stage. The reason is because the door is opened by overcoming a stop frictional force, adhesion of the gasket, a stop inertia of the door, and the like.

However, due to the foregoing gap D, the rack 130 cannot push the door at the initial stage of drawing in the rack 130. In other words, the rack 130 cannot push the door at all while the rack 130 is drawn out by the gap D.

Therefore, it is desirable that a sufficient force is maintained until the rack pushes the door to open the door after the rack is drawn out at the initial stage. That is, it is desirable that the drawing-out force of the rack should be maintained continuously.

The present embodiment includes a power transmission device that divides a driving force of the motor into a constant speed interval and an accelerated speed interval and transmits the divided driving force to the rack. The driving force of the motor may be transmitted to the rack by gear engagement. Therefore, preferably, a rack gear 131 is also provided at the rack 130.

The constant speed interval is an interval during which the rack moves at a constant speed at an initial stage of an operation of the door opening module. The accelerated speed interval is an interval during which the rack moves at an accelerated speed after the initial operation. That is, the constant speed interval may be an interval from a point at which the rack pushes the door and to a point at which the door is opened, and the accelerated speed interval may be an interval from the point at which the door is opened to a point at which an opening angle of the door increases. Here, the point at which the door is opened may be a point at which adhesion of the gasket is released. That is, the constant speed interval may be an interval until a point at which the adhesion of the gasket is released.

In order to form the constant speed interval and the accelerated speed interval, the power transmission device 200 includes a reduction gear 140, and the rack gear 131 engaged with the reduction gear 140 may be formed at the rack 130.

The reduction gear 140 may include a plurality of constant speed gear teeth 141 having a predetermined radius from a rotation center 143 and a plurality of acceleration gear teeth 142 having a radius gradually increasing from the rotation center 143.

The rack gear 131 may include a plurality of linear gear teeth 132 engaged with the constant speed gear teeth 141 and a plurality of oblique gear teeth 133 engaged with the acceleration gear teeth 142.

Details of changes in a movement speed and force of the rack through the reduction gear 140 and the rack gear 131 will be described later.

Figure 4:
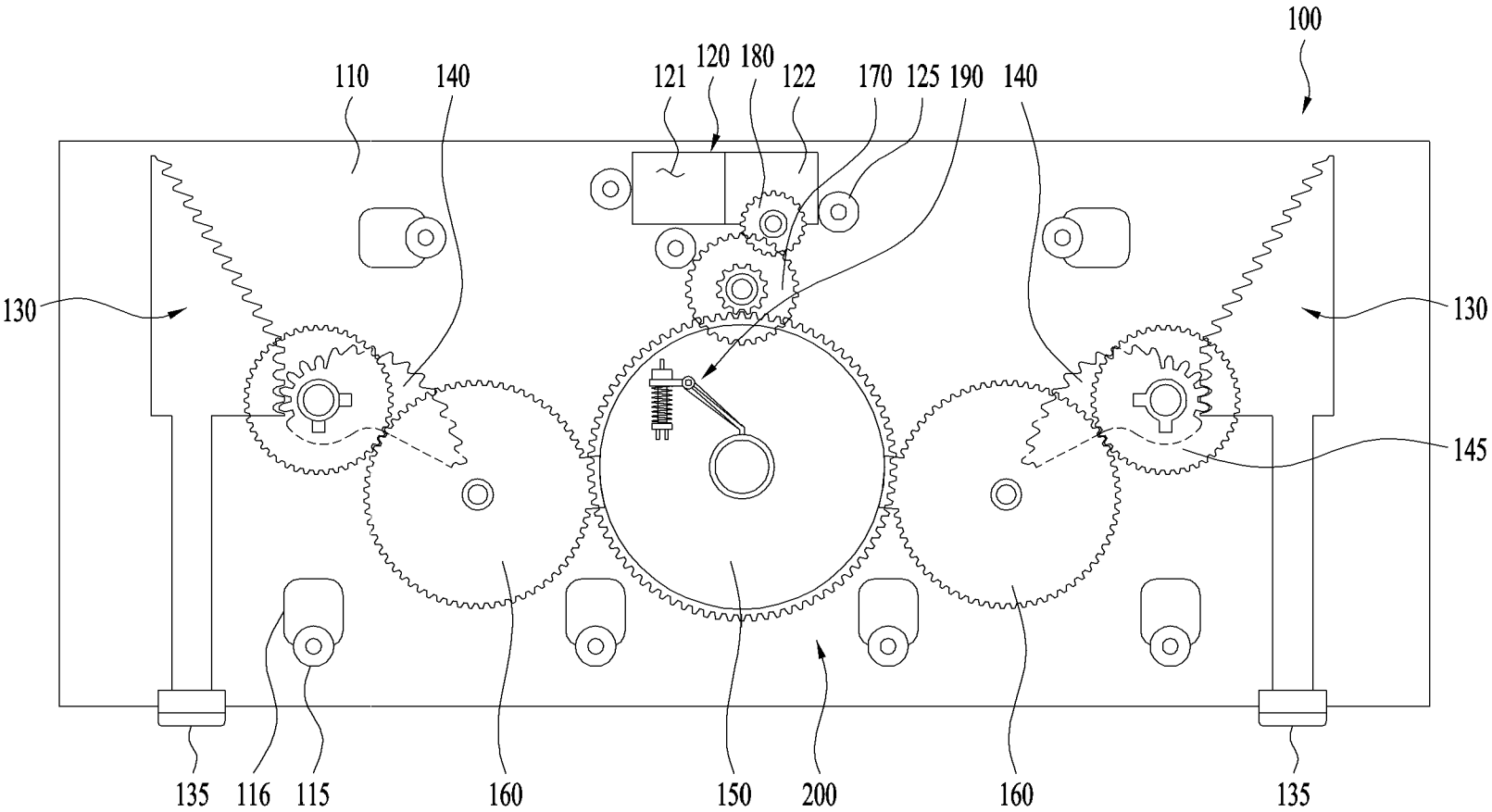
FIG. 4 is a plan view of the inside of a door opening module.
Figure 5:
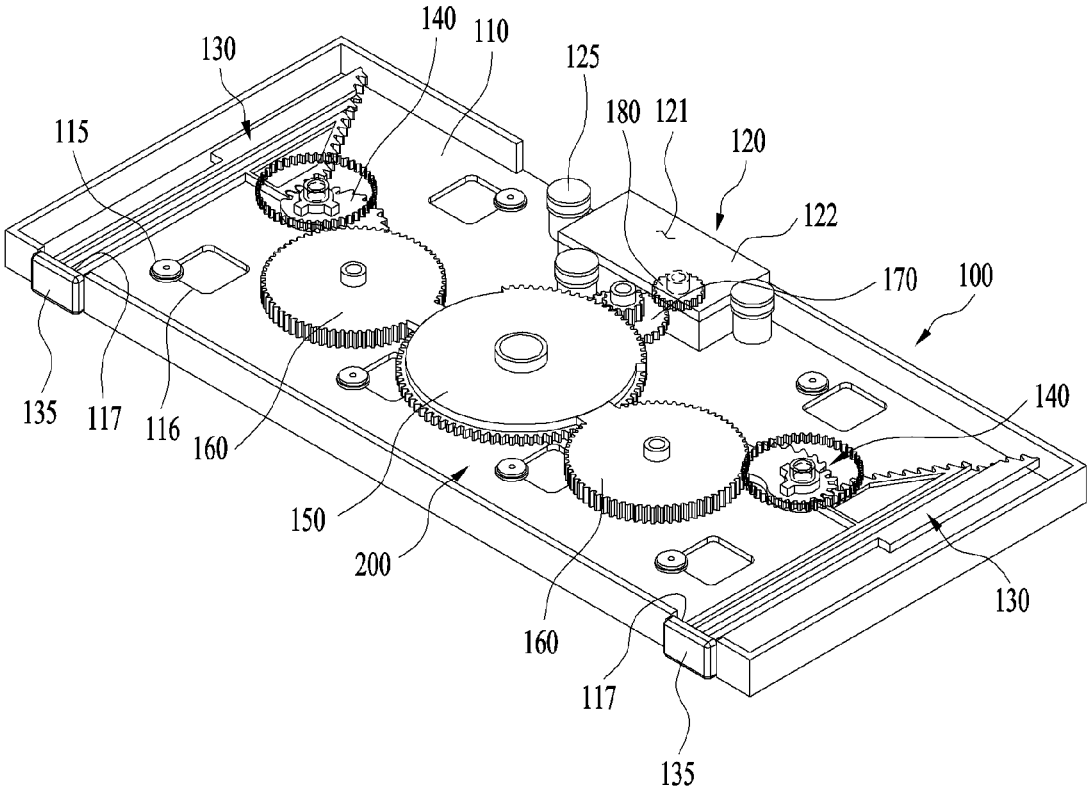
FIG. 5 is a perspective view of the inside of a door opening module.

As illustrated in FIG. 4, the reduction gear 140 may be formed integrally with a transmission gear 145. That is, the reduction gear 140 may be provided to rotate together with the transmission gear 145. The transmission gear 145 may be provided to be engaged with the intermittent gear 160.

Meanwhile, a transmission gear 170 for transmitting a driving force may be provided between the worm gear 180 and the central gear 150.

The housing 110 may be fixed to the cabinet through a plurality of anti-vibration members 115. A through hole 115 may be formed at the housing 110. The anti-vibration members 115 may be mounted on the housing through the through hole 115.

As described above, the drawing-out and drawing-in of each of the left and right racks differ depending on the rotation direction and a rotation angle of the single central gear 150. The single motor may simply perform forward and reverse rotation and cannot determine whether forward rotation or reverse rotation at a specific timing is drawing-in or drawing-out of a particular rack.

Therefore, as illustrated in FIG. 4, a switch 190 for determining a rotation angle or a current state of the single central gear 150 may be provided. The switch 190 may generate an ON/OFF signal according to a rotation position of the central gear 150. The rotation position of the central gear 150 may be recognized through a change in the ON/OFF signal.

Figure 6:
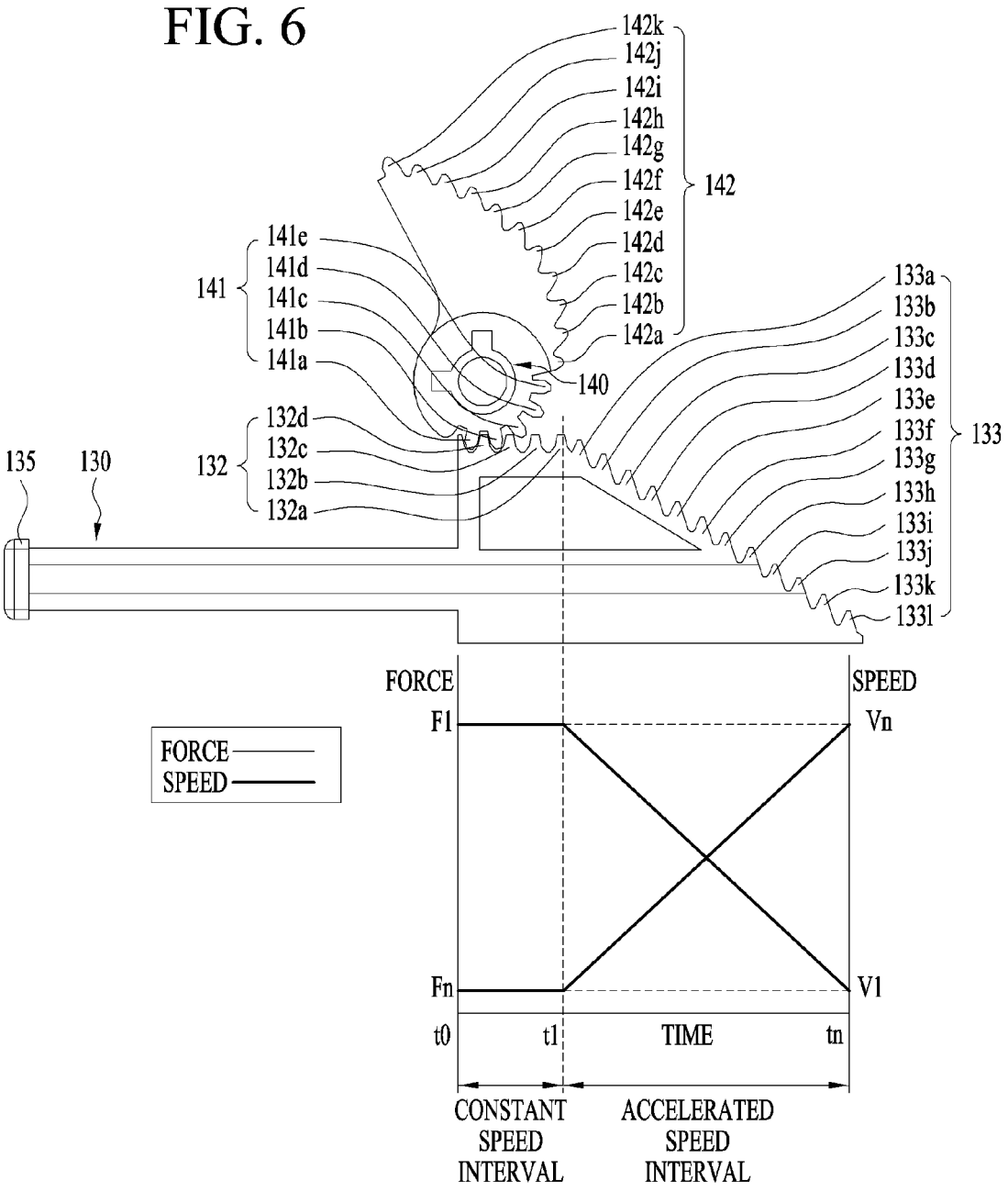
FIG. 6 illustrates a structure of a rack and a reduction gear and a transmission relationship of a force and a speed therebetween.

Hereinafter, a change in power between a constant speed interval movement and an accelerated speed interval movement of the rack 130 will be described in detail with reference to FIG. 6.

When the rack 130 moves at a constant speed, a force applied to the rack 130 is constant. That is, a driving force of the motor is constantly transmitted to the rack 130. Through this, the rack 130 may push the door with a constant force during the constant speed interval.

When the rack 130 moves at an accelerated speed, a force applied to the rack 130 is reduced. That is, as the speed increases, the force pushing the door through the rack is reduced.

Therefore, a unique gear structure is required to enable the constant speed interval and the accelerated speed interval movement of the rack 130.

First, the reduction gear 140 includes a plurality of constant speed gear teeth 141*a* to 141*e*. These constant speed gear teeth are provided to have the same radius from the center of rotation.

A plurality of linear gear teeth 132*a* to 132*a* are provided at the rack gear to correspond to the constant speed gear teeth. The linear gear teeth may be formed along a tangential direction from the center of rotation of the constant speed gear teeth.

Therefore, while the constant speed gear teeth and the linear gear teeth are engaged and driven, the rack moves at a constant speed. Of course, this is based upon the assumption that the reduction gear 140 rotates at a constant speed. In this constant speed interval, the force applied to the rack is constant. Therefore, the constant speed interval may be formed from a starting point at which the rack is drawn out to a specific point. That is, the constant speed interval may be formed until the rack pushes the door. Through this, efficiency may be increased and reliability of the door opening module may be increased.

Once the door is opened, that is, when adhesion of the gasket is released, the force required for opening the door is reduced. Therefore, it is desirable that the force for the rack to push the door is reduced.

Meanwhile, it is preferable that the speed at which the door is opened is increased. This is because, if the opening speed of the door is slow, the user has to wait tediously until opening of the door is terminated.

Therefore, it is preferable that once the door is opened, the opening angle of the door is rapidly increased.

In this embodiment, an accelerated speed interval may be formed after the constant speed interval, so that the door opening angle may be increased rapidly. That is, the speed of the rack 130 may be increased during the acceleration period.

The reduction gear 140 includes a plurality of acceleration gear teeth 142*a* to 142*k* whose radii gradually increase from the rotation center. Such a gear having the plurality of acceleration gear teeth may be referred to as a nautilus gear. To correspond to the acceleration gear teeth, the rack gear is provided with a plurality of oblique gear teeth 133*a* to 1331.

When the acceleration gear teeth and the oblique gear teeth are engaged and rotated, a drawing-out speed of the rack gradually increases. However, a force transmitted to the rack gradually decreases. Therefore, once the door is opened, the opening angle increases more rapidly.

Figure 7:
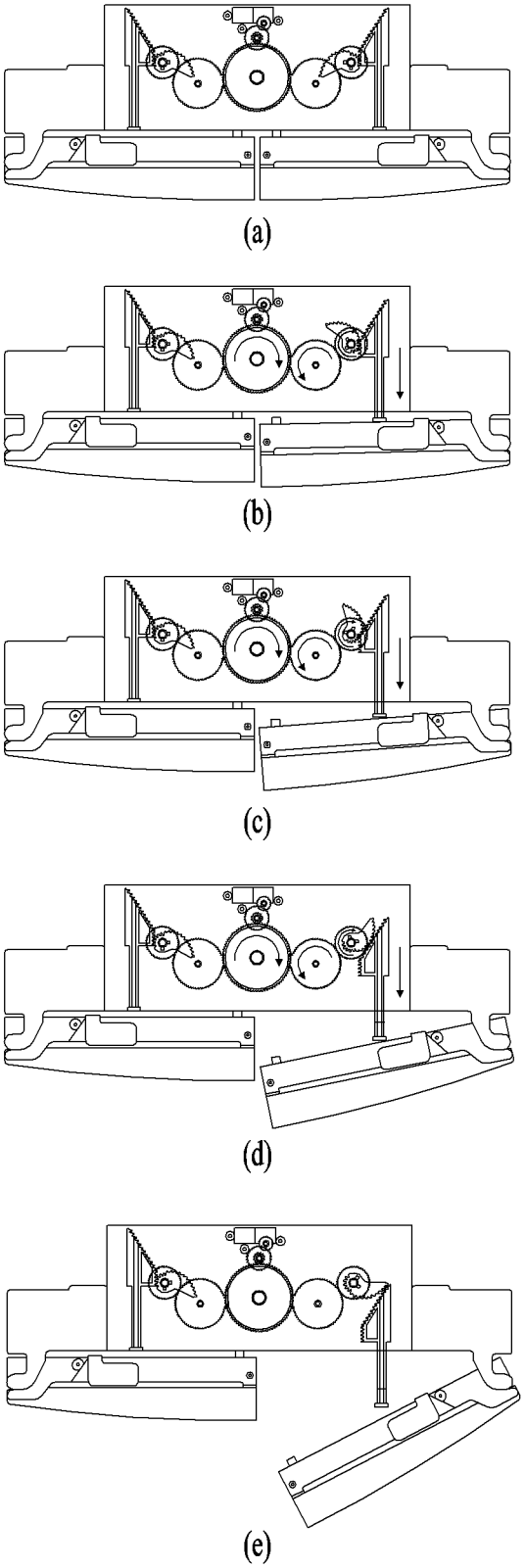
FIG. 7 illustrates a process of opening a right door.

FIG. 7 illustrates a process in which the right door is opened as the right rack is drawn out and drawing in.

In an initial state (FIG. 7(*a*)) that both the right and left doors are closed, both the left and right racks are drawn in. When the motor is driven in one direction and the central gear rotates in one direction, the rack starts to be drawn (FIG. 7(*b*)). That is, at the initial stage of drawing out the right rack, the constant speed interval is formed and adhesion of the gasket is released during the constant speed interval.

The constant speed interval is performed until the door is opened to such an extent that adhesion of the gasket is released (FIG. 7(*c*)). The door opening angle here may be approximately 4 degrees. When the constant speed interval is finished, the accelerated speed interval (FIG. 7(*d*)) is performed and the opening angle of the door is increased. Here, since the drawing-out speed of the right rack increases, the opening speed of the door also increases.

When the drawing out of the rack is completed, the door may be further opened by an inertial force based on the increase of the opening speed (FIG. 7(*e*)). Thus, finally, the door opening angle through the door opening module may be increased. After the drawing out of the rack is terminated, the operation of the door opening module is stopped for a predetermined time, and thereafter, the rack is drawn in.

The change in speed and force during the process of drawing in the rack is the same as the process of drawing out the rack. It is visually undesirable if the rack is slowly drawn in a state that the door is open. Therefore, it is preferable to allow the rack to be drawn out quickly after being drawn out. That is, the rack may be drawn in quickly through the accelerated speed interval. Also, immediately before the completion of the drawing in of the rack, the drawing in of the rack may be terminated stably through the constant speed interval.

Figure 8:
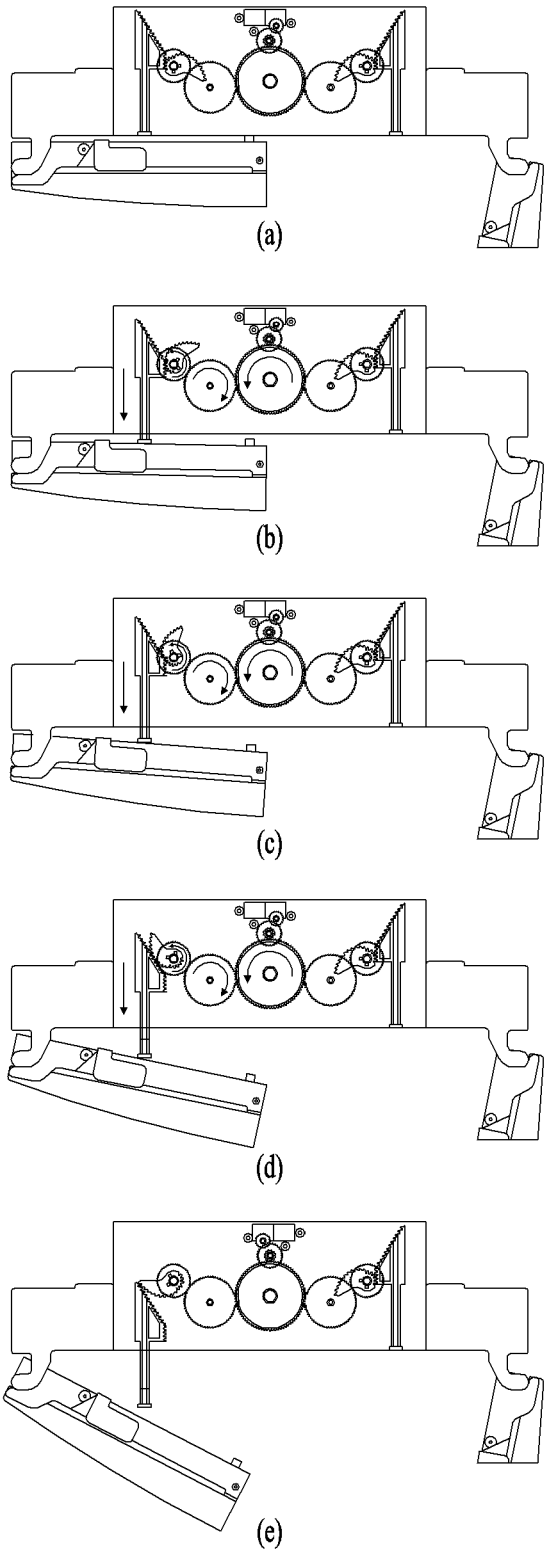
FIG. 8 illustrates a process of opening a left door.

FIG. 8 illustrates a process in which the left door is opened by drawing out and drawing in the left rack. It illustrates a case that the door opening module opens the left door after opening the right door. Therefore, the right door is opened and the right rack is drawn in before the left door is opened.

In an initial state (FIG. 8(*a*)) in which the right door is opened and the left door is closed, both the right and left racks are drawn in. When the motor is driven in the other direction and the central gear rotates in the other direction, the left rack starts to be drawn (FIG. 8 (*b*)). That is, at the initial stage of drawing the left rack, a constant speed interval is formed and adhesion of the gasket is released during the constant speed interval.

The constant speed interval is performed until the door is opened to such an extent that adhesion of the gasket is released (FIG. 8(*c*)). The door opening angle at this time may be approximately 4 degrees. When the constant speed interval is terminated, the accelerated speed interval (FIG. 8(*d*)) is performed and the opening angle of the door is increased. Here, since the speed of drawing in the left rack increases, the opening speed of the door also increases.

When the drawing out of the rack is terminated, the door may be further opened by an inertial force based on the increase in the opening speed (FIG. 8(*e*)). Thus, finally, the door opening angle may be increased through the door opening module. After the drawing out of the rack is terminated, the operation of the door opening module is stopped for a predetermined time, and thereafter, the rack is drawn in.

Through the above-described embodiment, the door opening module may open the left and right doors by the single motor. To this end, the door opening module is mounted in the cabinet.

However, the door opening module may be provided to open only one door by the single motor. For example, the door opening module may be provided to open only the right door. In this case, only one rack may be provided. In the case of opening only one door, the door opening module may be mounted on the door, not on the cabinet. Further, the structures such as the central gear and the intermittent gears provided on the right and left sides of the central gear may also be omitted.

The rack drawn out backwards from the door pushes the cabinet. Thus, the door may be opened. Of course, in this case, since a gap is formed between the door and the cabinet, preferably, the power transmission device having a constant speed interval and an accelerated speed interval is applied.

Hereinafter, a door opening module according to another embodiment of the present invention will be described in detail with reference to FIGS. 9 to 11. The same reference numerals are given to the same components as those of the above-described embodiment, and redundant descriptions will be omitted.

In the present embodiment, the configuration of the power transmission device 200 may be further simplified. For example, in the embodiment described above, the intermittent gear 160 and the transmission gear 145 are separately provided, but in the present embodiment, the intermittent gear and the transmission gear may be integrally applied.

Further, in this embodiment, the intermittent gear and the reduction gear may be integrally formed. Therefore, in the present embodiment, since one gear (or two gears in the case of bilateral symmetry) is omitted, it is possible to implement a compact door opening module. Therefore, the size of the module housing is also reduced.

Inside the housing, a bridge 185 may be provided, and internal electric wires may be fixed through the bridge 185.

Figure 9:
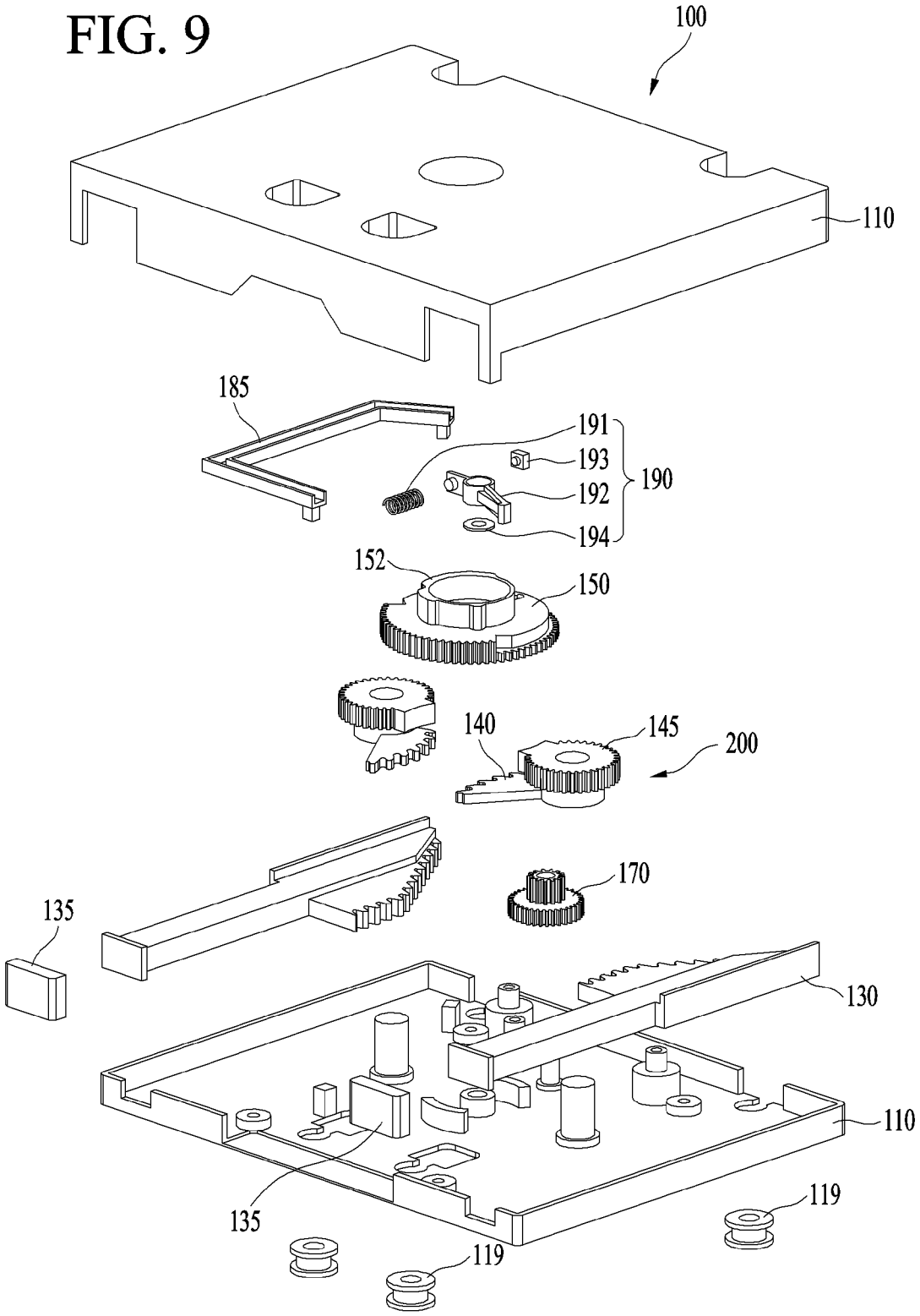
FIG. 9 is an exploded perspective view of a door opening module according to another embodiment of the present invention.
Figure 11:
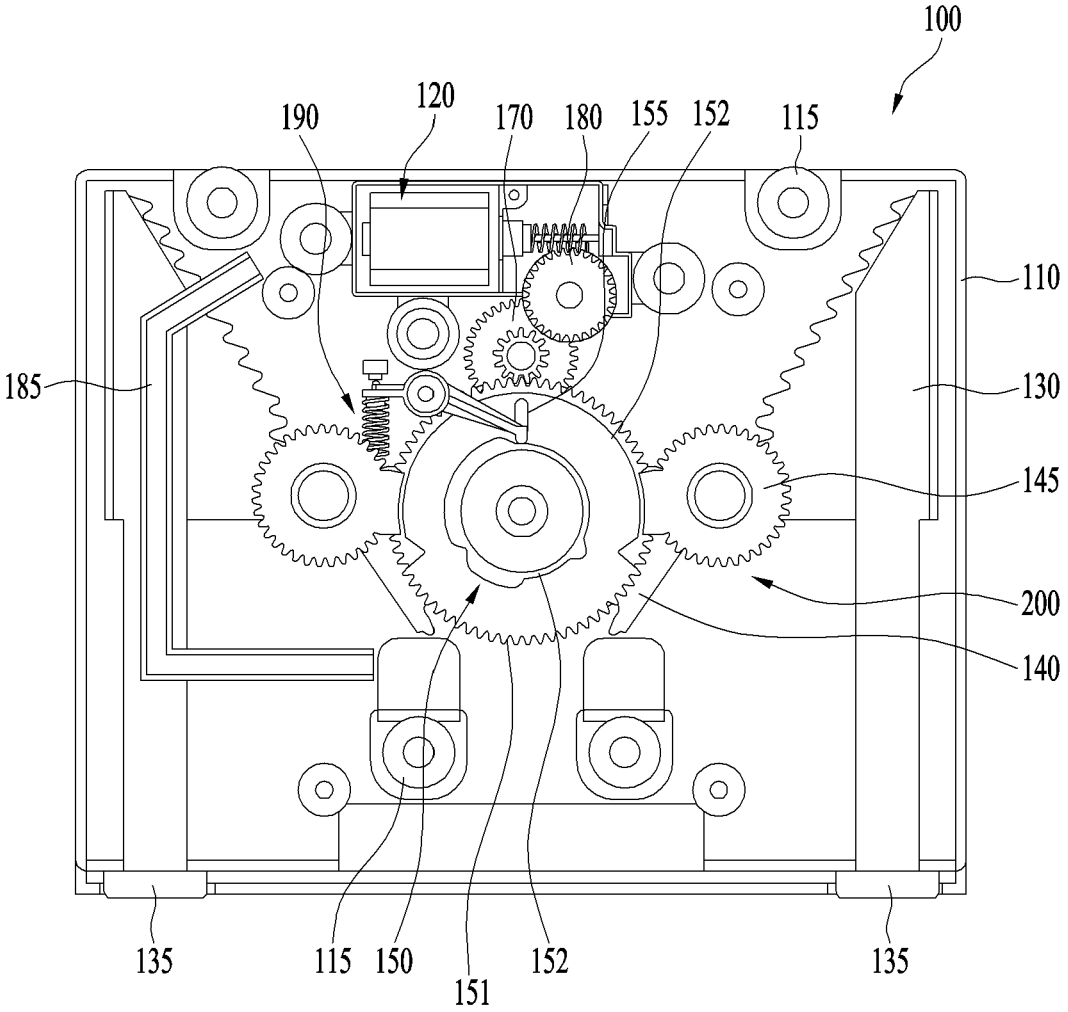
FIG. 11 is an internal plan view of the door opening module illustrated in FIG. 9.

In FIGS. 9 and 11, the structure of a switch 190 is clearly illustrated.

The switch 190 includes a switch element 193 and a lever 192 for switching the switch element. The lever 192 may be formed such that when one end thereof rises with respect to the center thereof, the other end is lowered, and when one end is lowered, the other end rises.

The switch element 193 may be selectively switched by one end of the lever 192. The switch 190 may include a lever holder 194 and a spring 191 for fixing the lever. As will be described later, the left and right doors may be sequentially controlled through the single motor through a change in a switching signal of the single switch 190, for example, a change in ON/OFF.

The other end of the lever 192 may be provided to be in contact with a cam 152 provided at the central gear 150. That is, it may be provided to detect a change in height according to rotation of the cam. A change in the height occurs at the other end of the lever 192, which is switched to a change in height of one end of the lever 192. The change in height of the lever 192 causes a change in a switching signal. For example, an ON signal for pressing the switch and an OFF signal for not pressing the switch may be generated.

Figure 10:
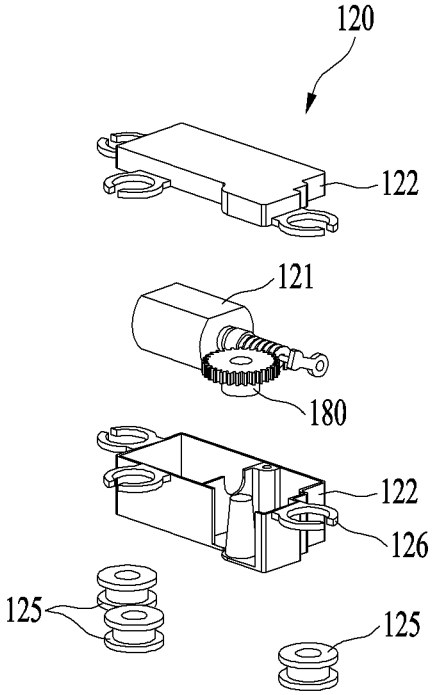
FIG. 10 is an exploded perspective view of a motor assembly illustrated in FIG. 9.

FIG. 10 illustrates a motor assembly. Since the door opening module is mounted at an upper portion of the cabinet, a height of the door opening module is preferably low. Thus, the motor 121 is preferably received in the motor housing 122 in a state in which a rotary shaft thereof is laid to be horizontal. The motor housing may include an upper housing and a lower housing.

A mounting portion 166 is formed at the motor housing and an anti-vibration member 125 is mounted at the mounting portion 166, so that the motor housing is mounted inside the module housing.

A worm gear 180 may be provided to pass through the motor housing. The worm gear 180 transmits a driving force between the motor rotary shaft provided inside the motor housing and a transmission gear 170 provided outside the motor housing. The structure of the motor assembly is not limited to a specific embodiment.

As illustrated in FIG. 11, at an initial position where both left and right racks are drawn in, the central gear 150 is also located at the initial position. For example, the central gear 150 may be provided with a mark or a groove 155 for indicating the initial position. When the groove 153 is at a 12 o'clock position, the door opening module may be considered to be at the initial position. The lever of the switch 190 also comes into contact with a portion corresponding to the initial position of the central gear.

Hereinafter, a relationship between the single switch and a current state of the door opening module will be described in detail with reference to FIGS. 12 and 13.

When the lever 192 of the switch is located at the initial position of the central gear 150, both the left and right racks are in the initial state that they are drawn in.

The central gear 150 includes a cam 152 and the central gear 150 and the cam 152 are integrally rotated.

The central gear 150 is provided not to rotate 360 degrees or greater continuously in a specific direction. That is, a rotation direction and a rotation angle of the central gear may be performed through controlling of driving of the motor.

The switch 190 is turned on at the initial position.

A switch ON interval, a switch OFF interval, and a switch ON interval may be continuously formed up to an angle of 180 degrees along the clockwise direction with respect to the initial position.

A switch ON/OFF switching interval, a switch OFF interval, a switch ON interval, and a switch OFF interval may be continuously formed along the counterclockwise direction with respect to the initial position.

Figure 12:
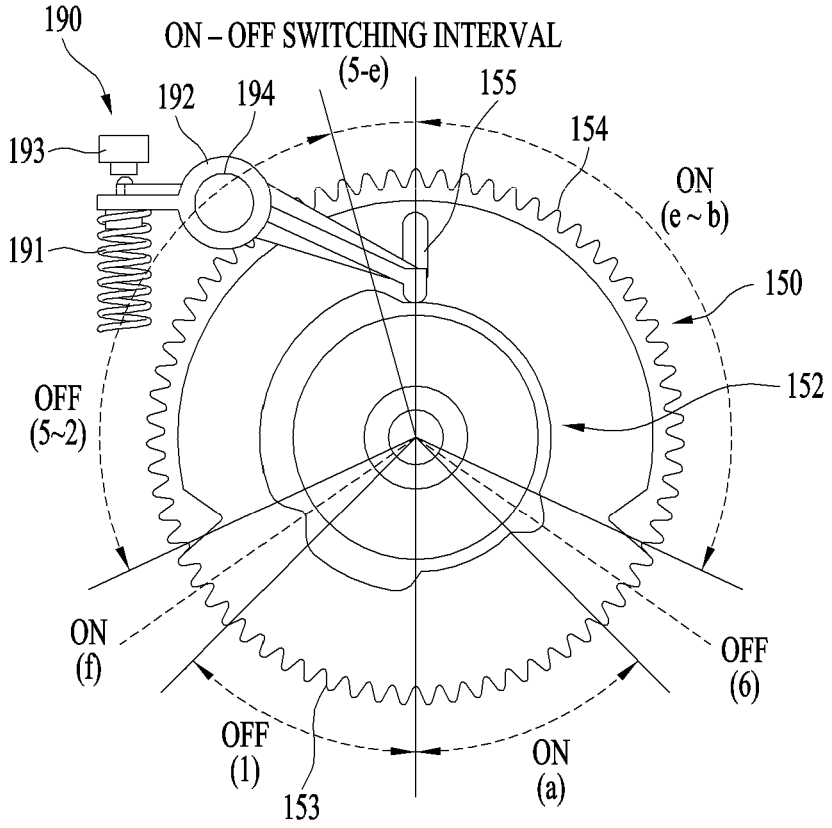
FIG. 12 illustrates a switching relationship between a position of a central gear and a switch illustrated in FIG. 9.

In FIG. 12, the switch ON/OFF switching interval is exaggerated to have a relatively large angular range. Due to the shape of an actual cam, the switch ON/OFF switching period is formed in a very small angular range in the vicinity of the initial position.

The central gear 150 is rotated in the forward and reverse directions from the start of operation of the door opening module to the end thereof (that is, until both the left and right racks are returned to the initial position after any one of the doors starts to be opened and both the doors are opened). Accordingly, the ON/OFF pattern of the switch varies. A current position of the right and left racks may be recognized through ON/OFF of this single switch.

Therefore, the controller controls the forward and backward driving and stopping of the single motor through the ON/OFF operation of the single switch. That is, the controller controls the operation of the door opening module by controlling driving of the motor.

The cam 152 is formed to be different in left and right shapes with respect to the initial position. Therefore, switching patterns are formed to be different when rotated by 180 degrees in the clockwise direction from the initial position and when rotated by 180 degrees in the counterclockwise direction.

Further, the cam 152 is formed to be inversion-symmetrical with respect to the initial position. That is, the cam has a shape in which the left and right are inversed with respect to the initial position to generate an inversed switching signal.

Figure 13:
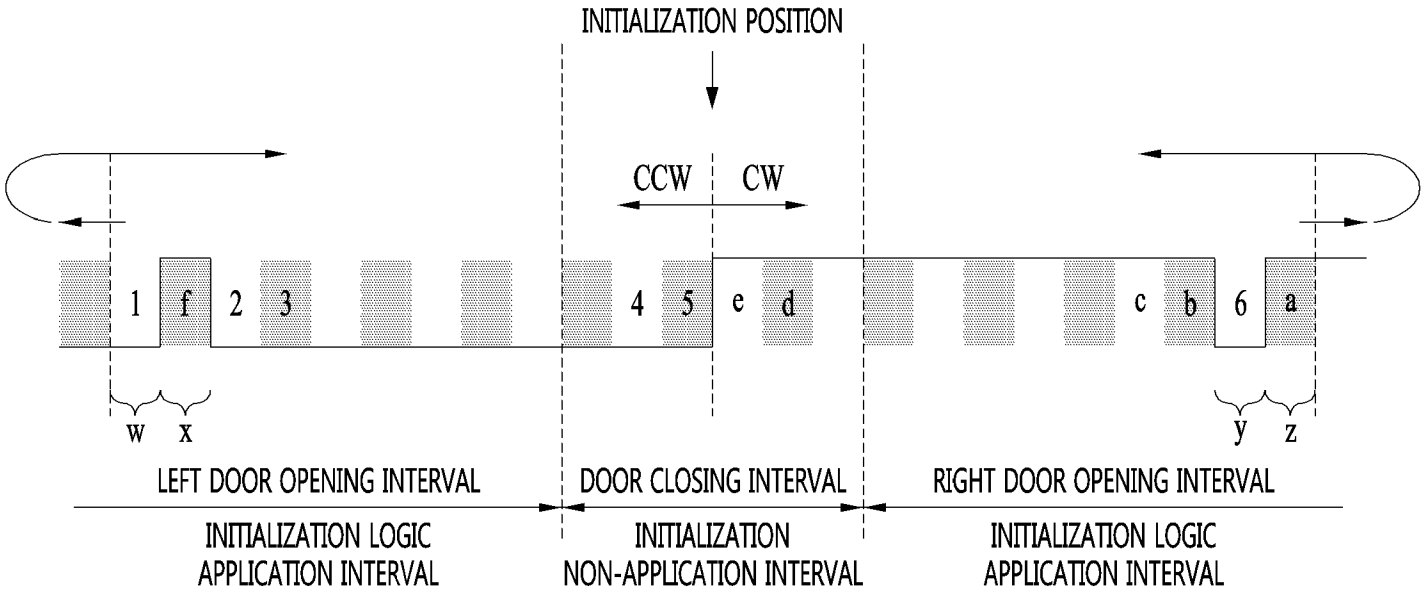
FIG. 13 illustrates a correlation between a switching change according to a forward and reverse rotation angle sections of the central gear illustrated in FIG. 9, a current state of left and right racks and an initial position.

For example, in FIG. 13, the switching patterns on the left and right are inversely symmetrical with respect to the initial position. Also, angular ranges corresponding to the change intervals of the switching patterns are mutually different.

A relationship between the central gear, the intermittent gear, and the switch when the right door is opened will be described with reference to FIG. 14.

Figure 14:
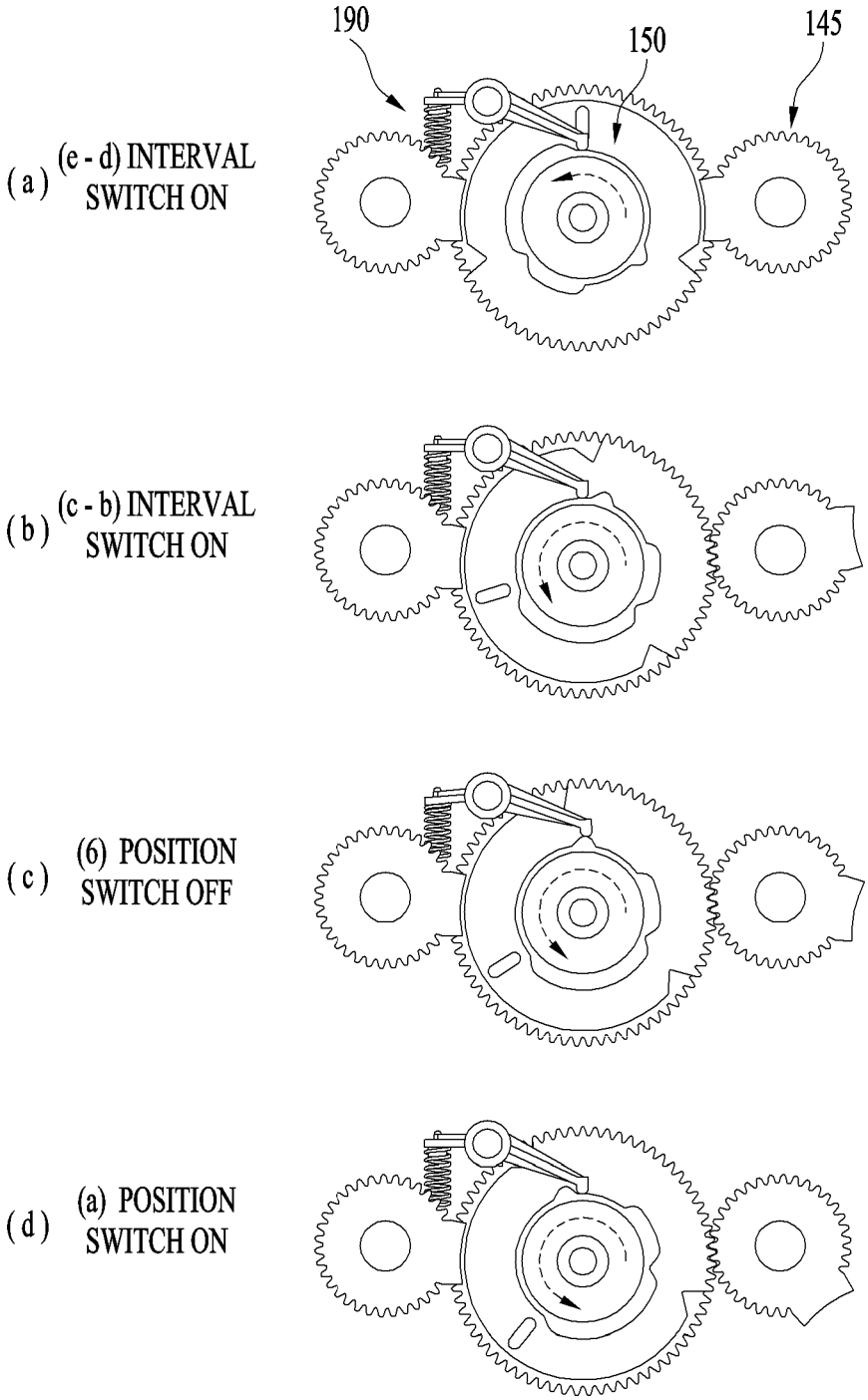
FIG. 14 illustrates a process of a switching change in the process of opening a right door.

As the central gear 150 rotates in the counterclockwise direction from the initial position (FIG. 14(*a*)), the right door may start to be opened. Here, the central gear 150 may be connected only with the intermittent gear 145. Thus, the counterclockwise rotation of the central bear is switched to clockwise rotation of the intermittent gear 145.

While the ON state of the switch is maintained, the counterclockwise rotation of the central gear 150 continues (FIG. 14(*b*)).

When the central gear 150 further rotates in the counterclockwise direction, the switch is switched to be turned off (FIG. 14(*c*)). Also, the counterclockwise rotation of the central gear 150 further continues and the switch is switched to be turned on (FIG. 14(*e*)).

The central gear 150 further rotates in the counterclockwise direction and then stops. At this time, it is considered that the right rack is drawn out to the maximum. When the right rack is drawn out to the maximum, the switch is in an ON state.

Therefore, signals of the switch are varied in order of ON, OFF, and ON until the right rack is drawn out to the maximum from the initial position. Here, it is recognized that the first switch ON interval or time is significantly larger than the later switch ON interval or time.

After the right rack is drawn out to the maximum, for example, the rotation of the central gear 150 is stopped for 1 to 2 seconds, and thereafter, the central gear is rotated in the clockwise direction in the process which is the reverse of the process illustrated in FIG. 14. Here, the switch is varied in the order of ON, OFF, and ON.

Here, it can be seen that the initial switch ON interval or time is significantly smaller than the later switch ON interval or time.

Figure 15:
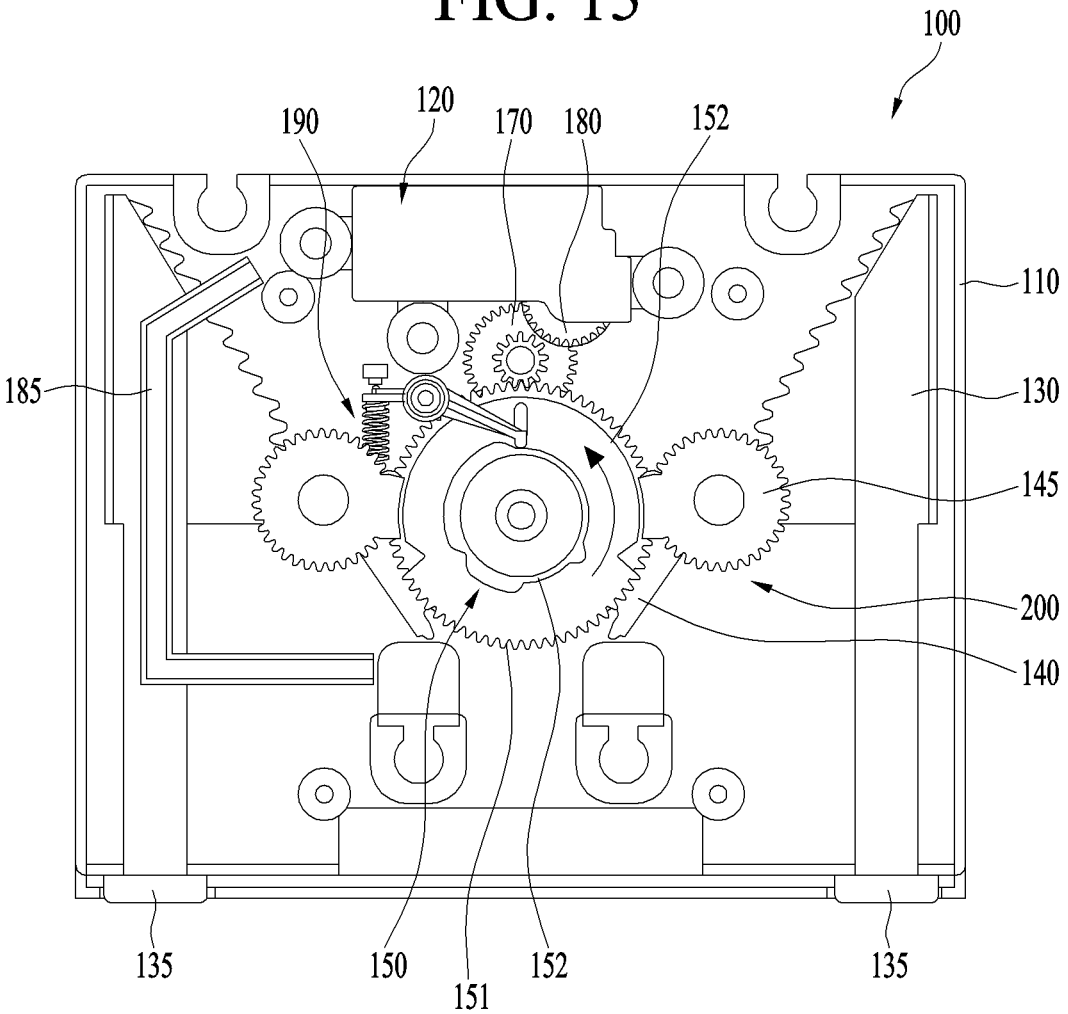
FIGS. 15 to 17 illustrate a configuration of a door opening module in the process of opening a right door.
Figure 16:
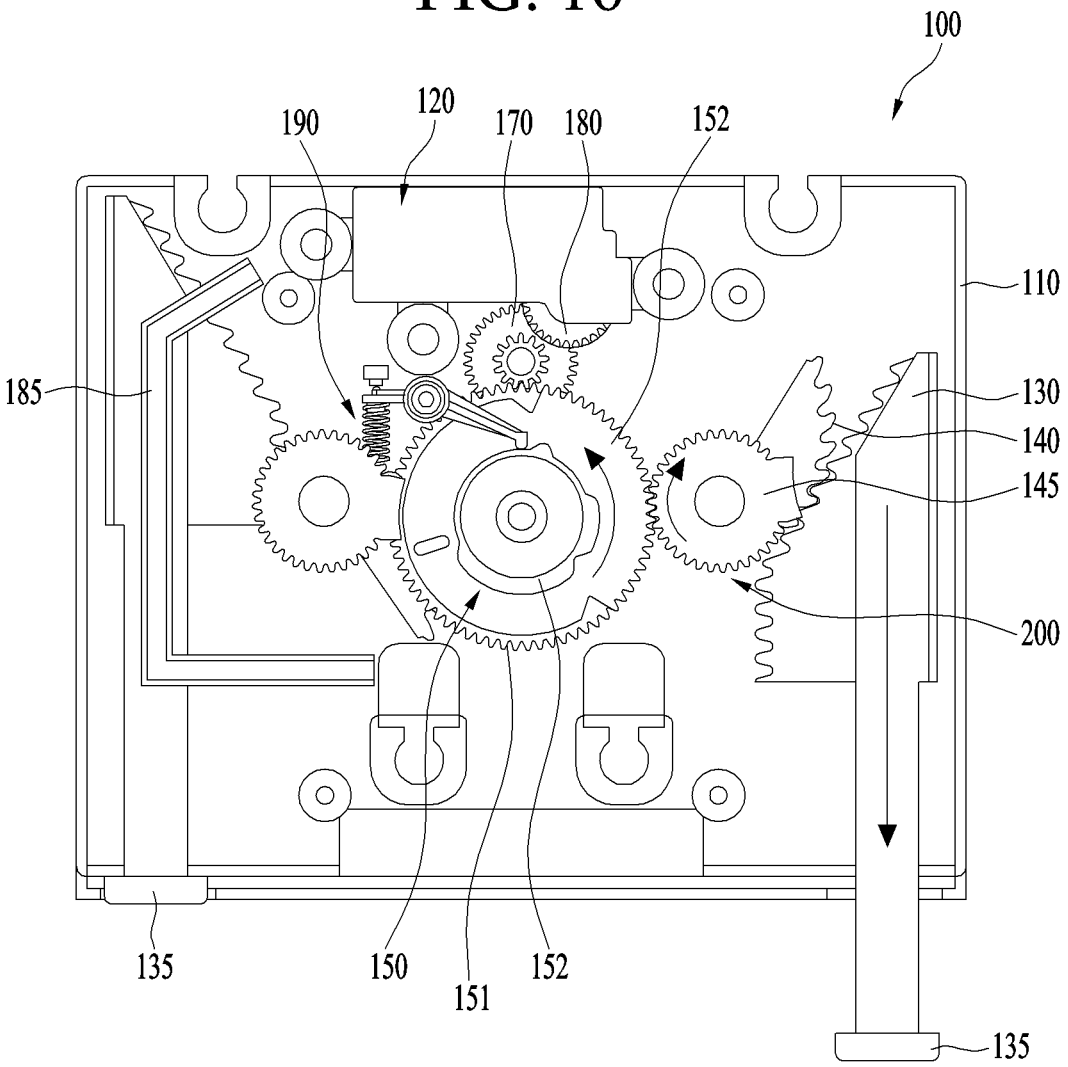
Figure 17:
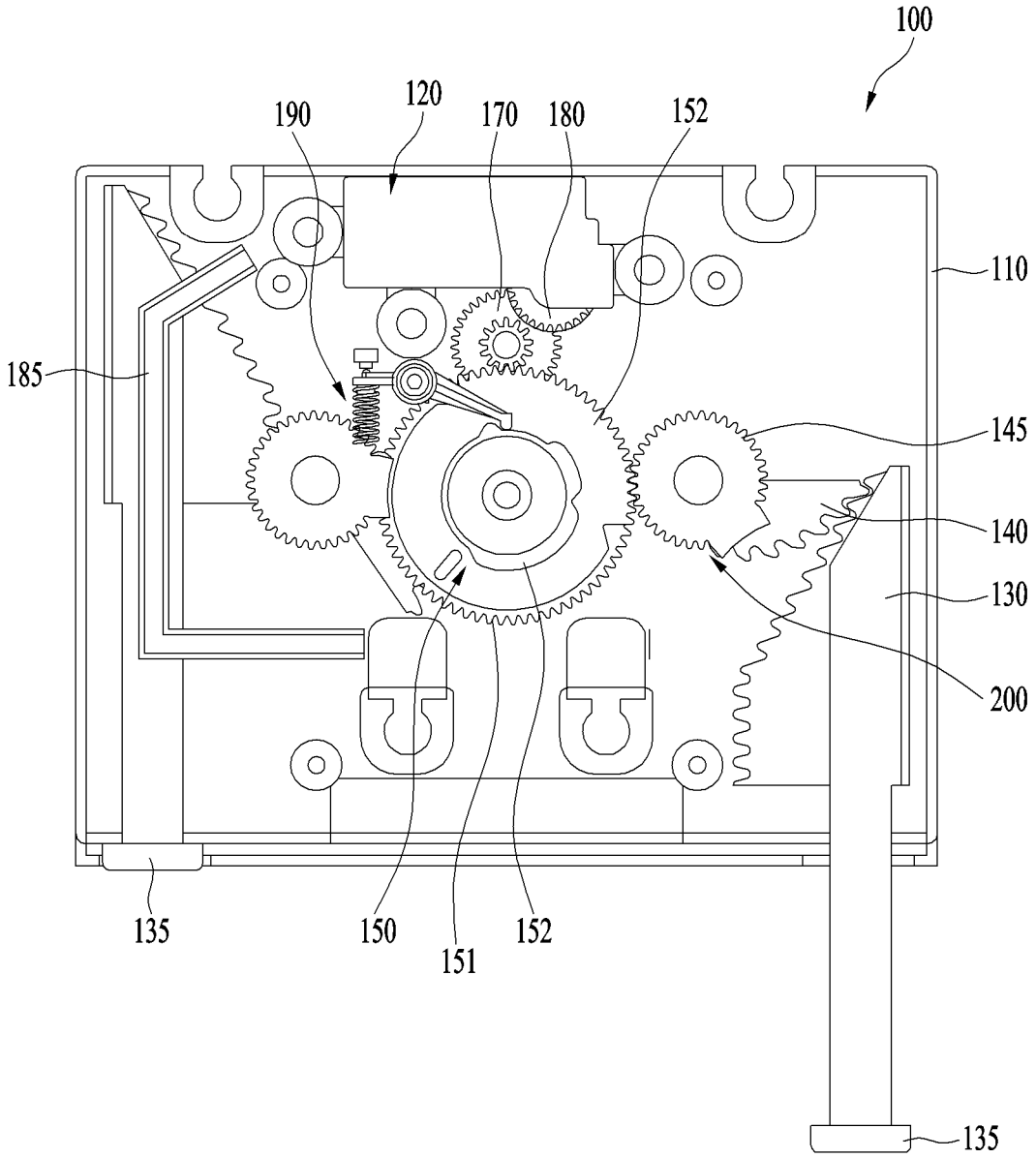

FIGS. 15 to 17 illustrate the door opening module until the right rack starts to be drawn out from the initial position and is drawn out to the maximum.

The relationship between the central gear, the intermittent gear, and the switch when the left door is opened will be described with reference to FIG. 18.

When the right door is opened and the right rack is completely drawn in, the central gear rotates in the clockwise direction. Here, the clockwise rotation of the central gear to allow the right rack to be drawn in continues without stopping. When the central gear rotates in the clockwise direction after passing through the initial position, the central gear is disengaged from the right intermittent gear and engaged with the left intermittent gear.

Figure 18:
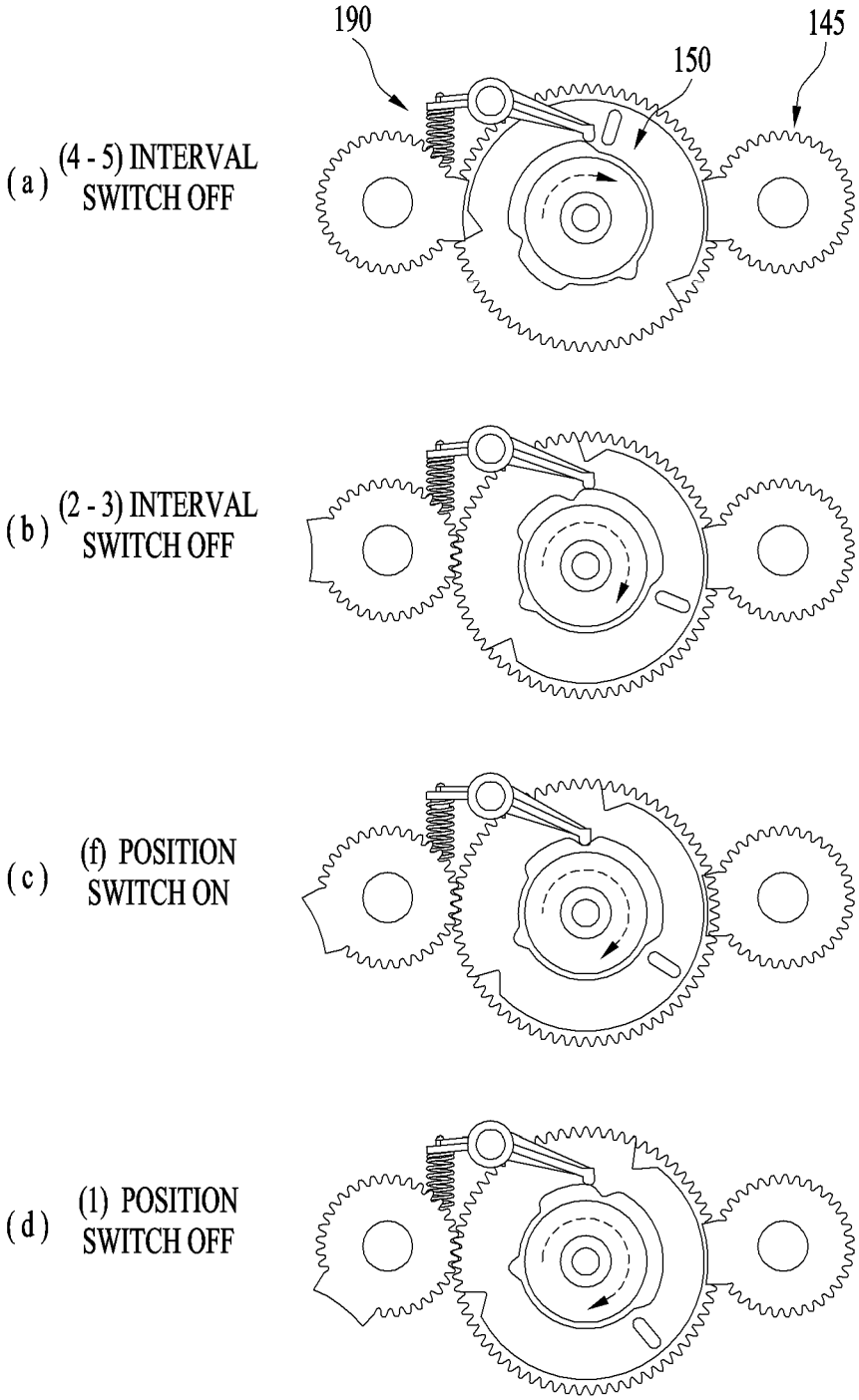
FIG. 18 illustrates a process of a switching change in the process of opening a left door.

Here, the switch is switched to be turned off (FIG. 18(*a*)). As the central gear 150 rotates in the clockwise direction, the left door may start to be opened.

While the OFF state of the switch is maintained, the clockwise rotation of the central gear 150 continues (FIG. 18(*b*)).

When the central gear 150 further rotates in the clockwise direction, the switch is switched to be turned on (FIG. 18(*c*)). Also, the clockwise rotation of the central gear 150 further continues and the switch is switched to the OFF state (FIG. 18(*e*)).

The central gear 150 further rotates in the clockwise direction and then stops. Here, it can be considered that the left rack is drawn out to the maximum. In the state that the left rack is drawn out to the maximum, the switch is in an OFF state.

Therefore, signals of the switch is varied in order of OFF, ON, and OFF until the left rack is drawn out to the maximum after the right rack is drawn in. Here, it can be seen that the first switch OFF interval or time is significantly greater than the later switch OFF interval or time.

In a state that the left rack is drawn out to the maximum, for example, after rotation of the central gear 150 is stopped for, for example, about 1 to 2 seconds, the central gear rotates in the counterclockwise direction in the process opposite to that illustrated in FIG. 18. Here, the switches are varied in order of OFF, ON, and OFF.

Here, it can be seen that the first switch OFF interval or time is significantly smaller than the later switch OFF interval or time.

Figure 19:
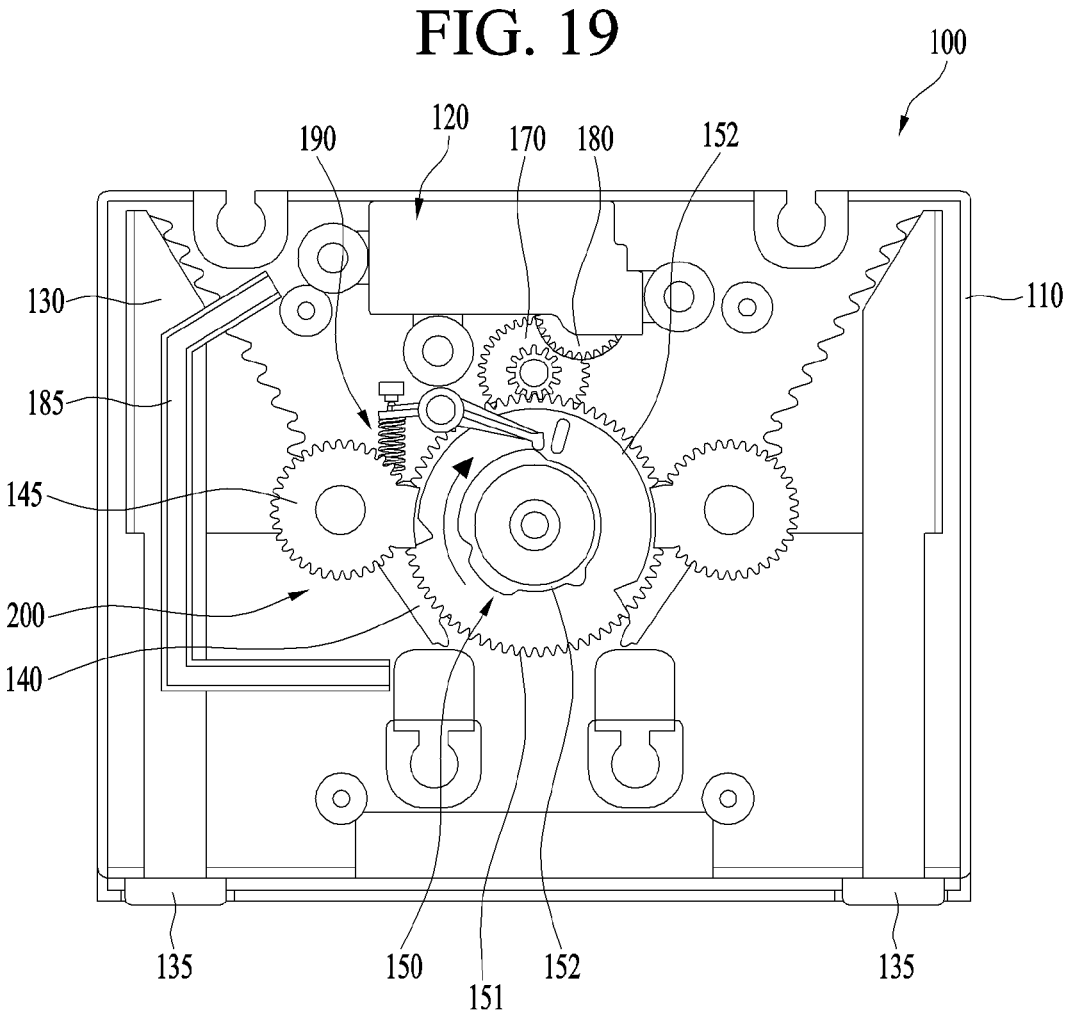
FIGS. 19 to 21 illustrate a configuration of a door opening module in the process of opening a left door.
Figure 20:
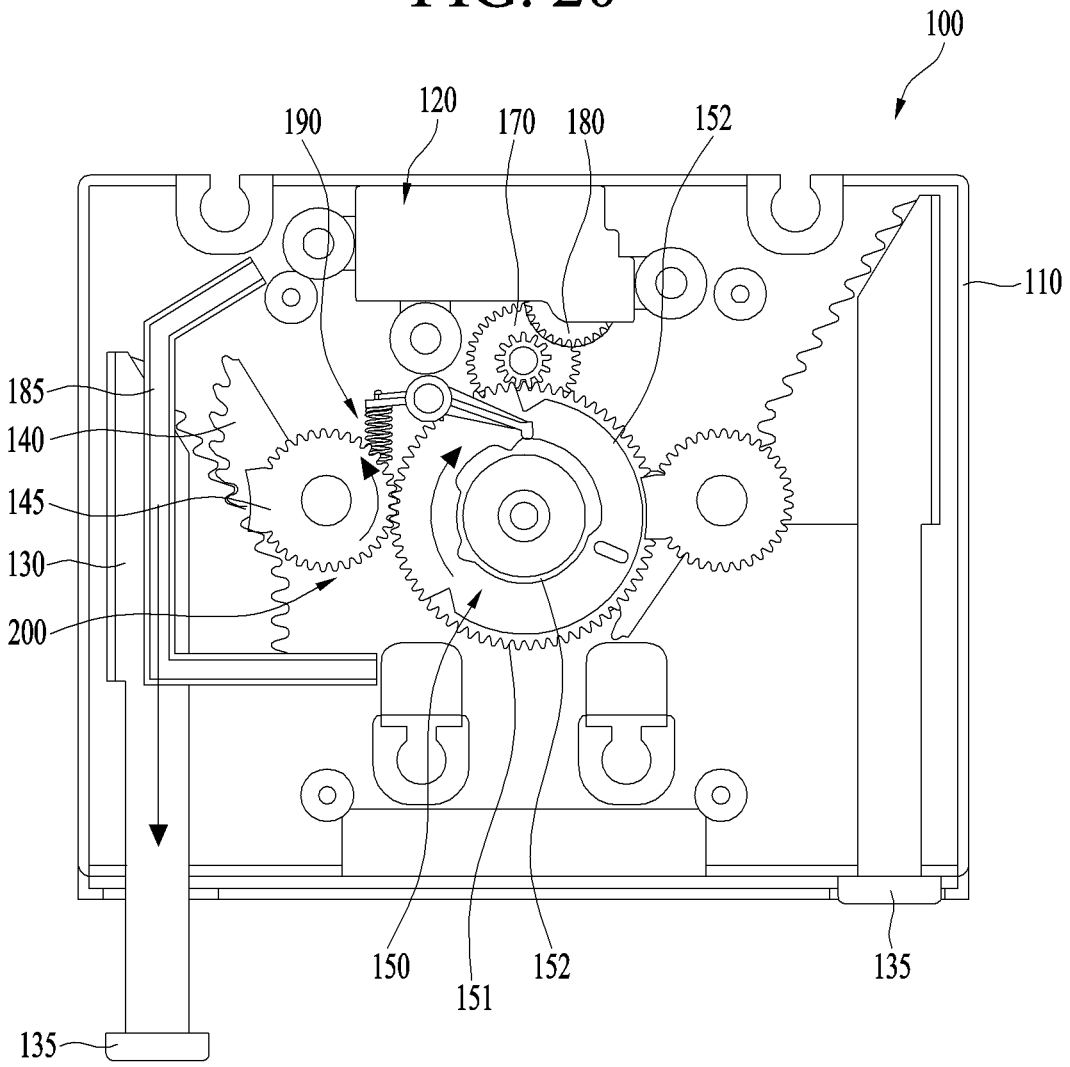
Figure 21:
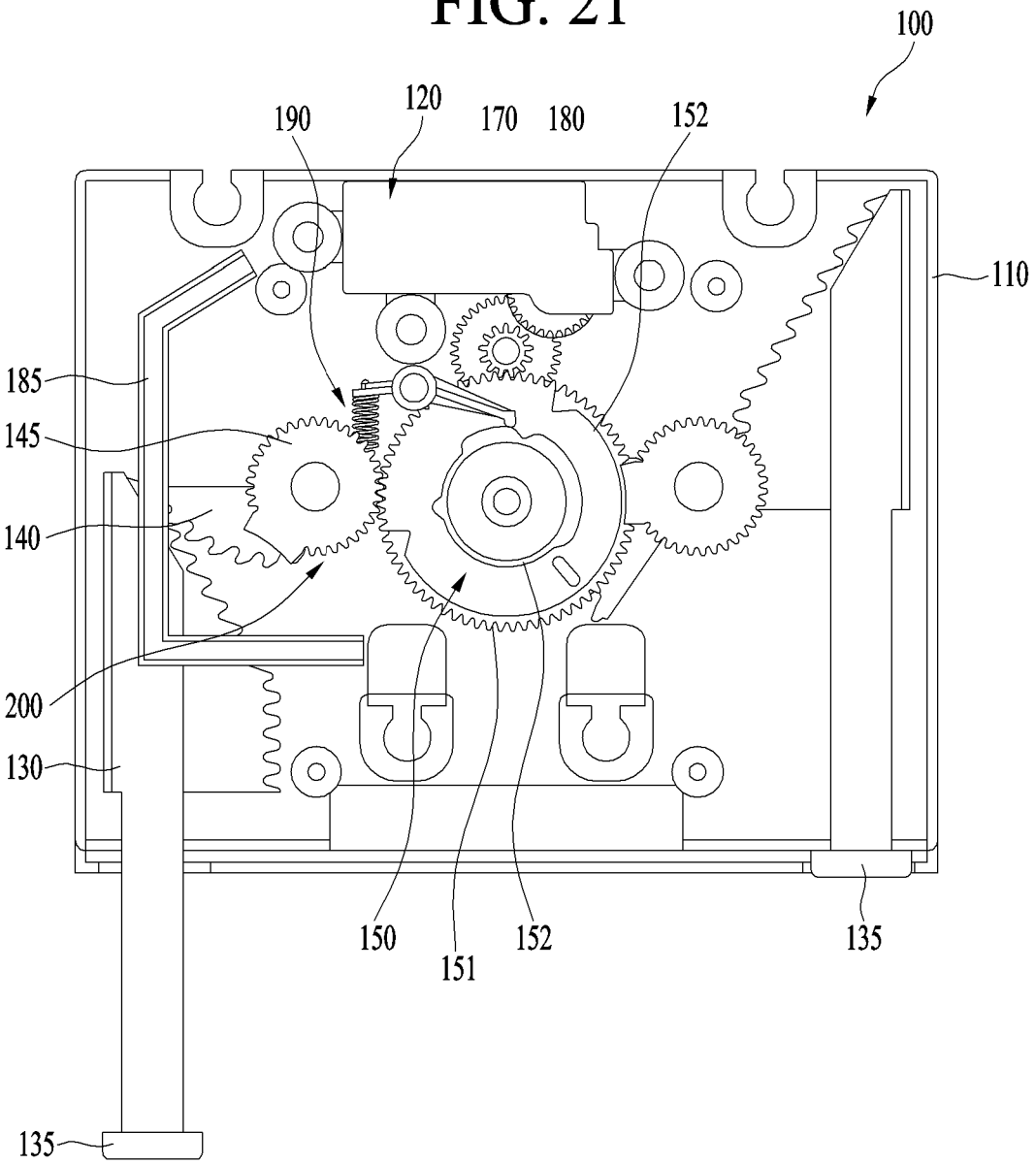

FIGS. 19 to 21 illustrate a configuration of the door opening module until the right rack starts to be drawn out from the initial position and is drawn out to the maximum.

In FIG. 13, a door closing interval may be set near the initial position. That is, the door closing interval may be about a range in which whether the door is closed is determined within a relatively small angular range horizontally. For example, since a gap is present between the cabinet and the door as described above, the range may be a range in which the end of the rack is located in the gap.

Figure 22:
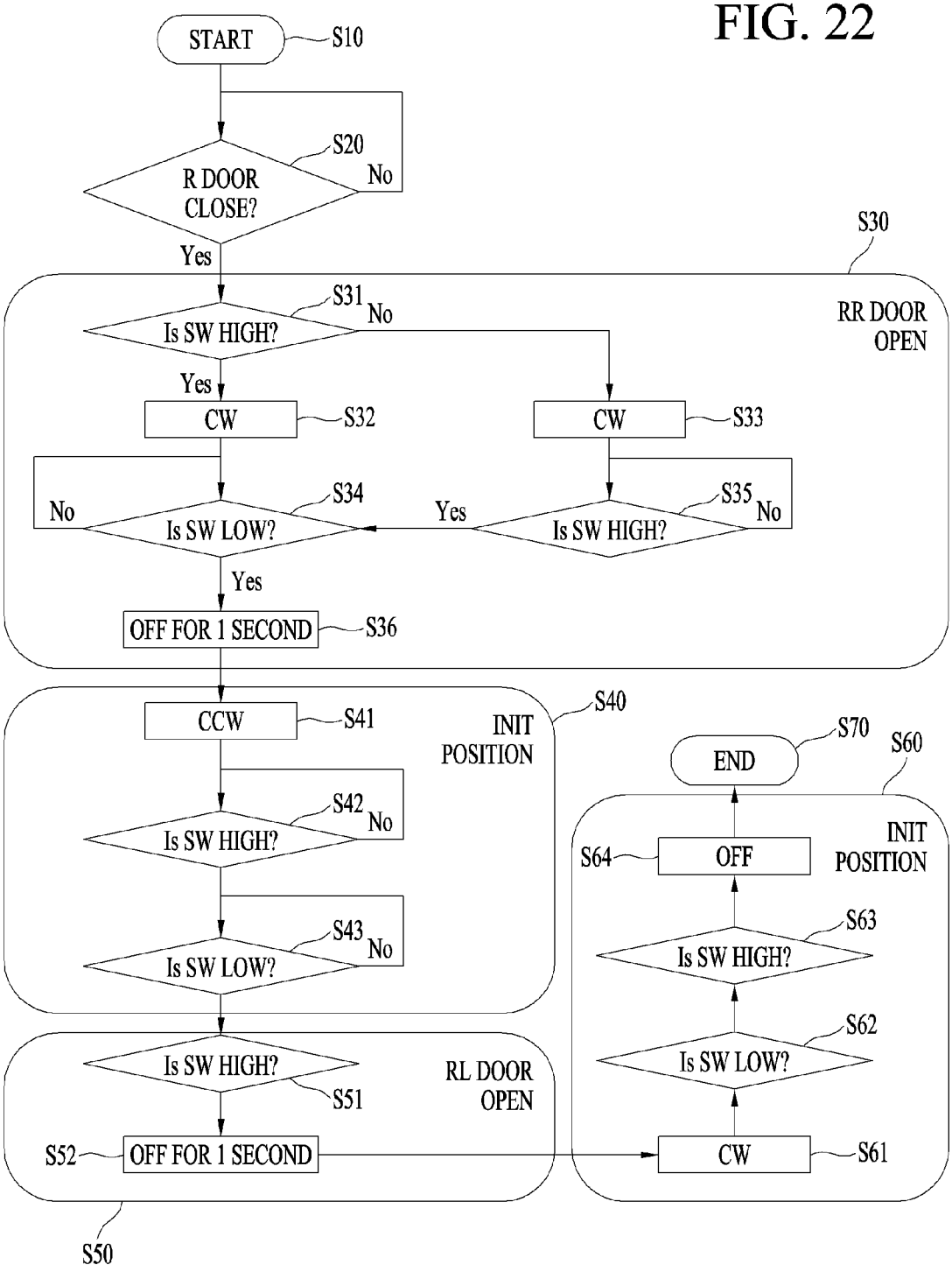
FIG. 22 is a flowchart of a process of opening left and right doors.

Therefore, if the central gear is not accurately present at the initial position but is located within three pulses on the left and right, it is determined to be normal and the normal door opening process illustrated in FIG. 22 is performed. Of course, such a door opening process may be performed after the user's intention to open the door is presumed through a sensor or an input unit.

Figure 23:
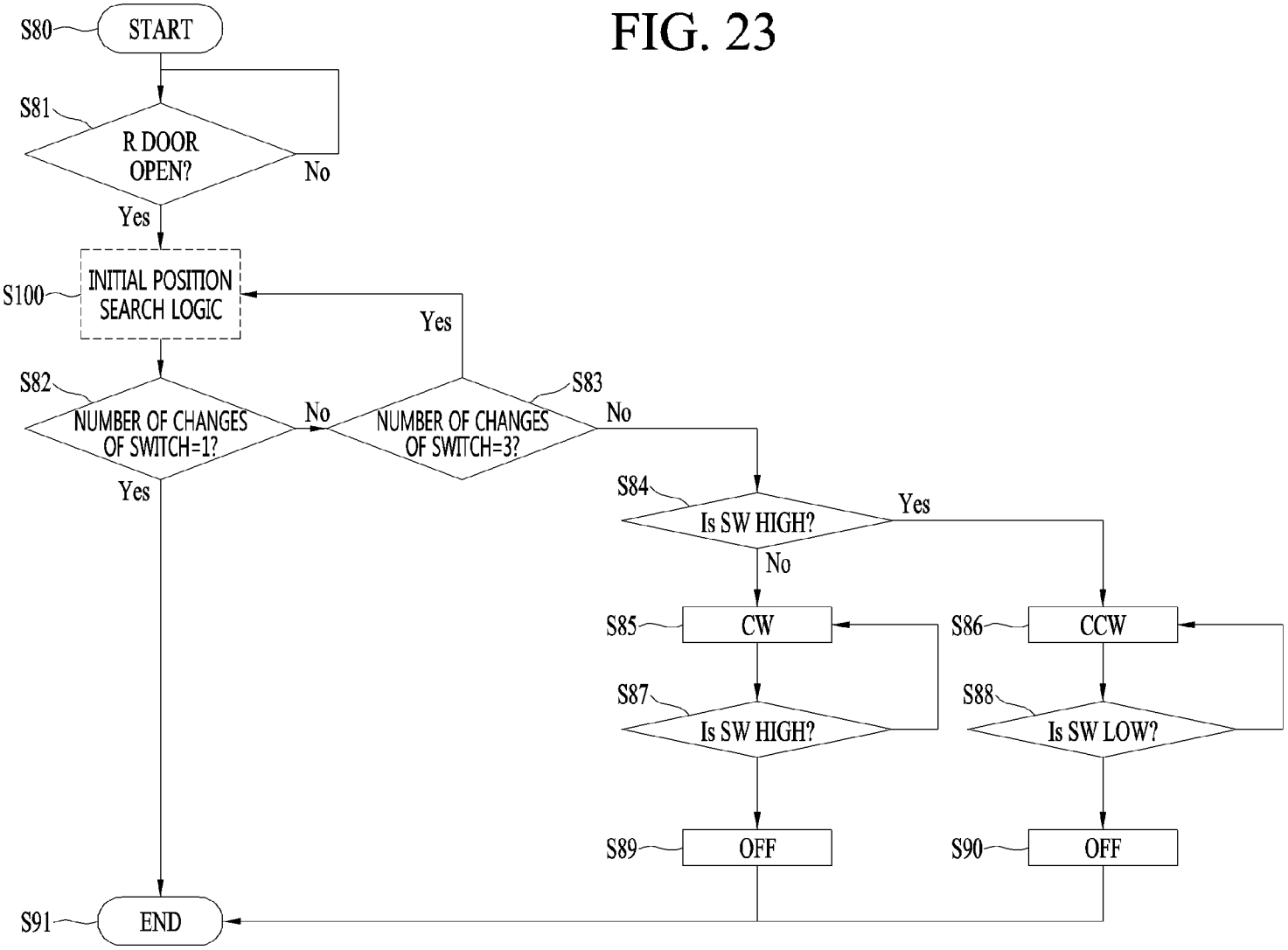
FIG. 23 is a flowchart of an initialization process.
Figure 24:
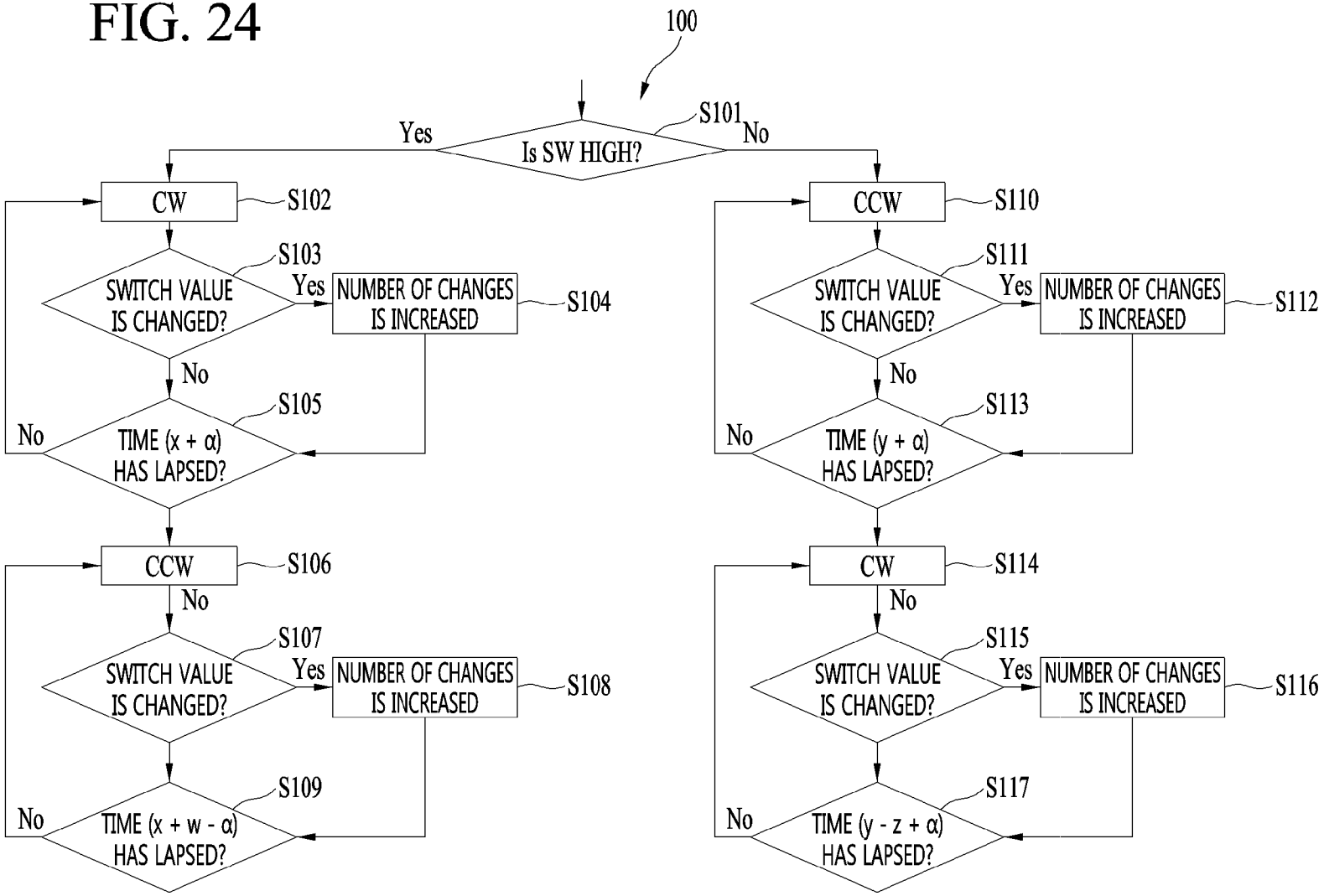
FIG. 24 is a flowchart of initial position search.

Meanwhile, when power of the refrigerator is released while the door opening module operates or when power is first applied after the refrigerator is purchased, the door opening module may belong to the door opening interval illustrated in FIG. 13. In this case, an initialization process illustrated in FIG. 23 is performed. Here, the initial position of the central gear must be searched. Preferably, the ON/OFF switching point of the switch illustrated in FIG. 13 must be accurately searched as the initial position. Therefore, preferably, an initial position search process illustrated in FIG. 24 is performed in an initialization process.

Hereinafter, a normal door opening process will be described with reference to FIG. 22.

First, when a door opening signal is applied, a door opening process starts (S10).

In order to perform the door opening, the door of the refrigerator must be closed. Step S20 is performed to determine whether the door of the refrigerator is closed. Whether the door of the refrigerator is closed may be determined by a general door switch.

In case that the door is closed, the right door is opened (S30), the right rack is returned to an initial position (S40), the left door is opened (S50), and the left rack is returned to the initial position (S60), and thereafter, the normal door opening process is terminated (S70).

In the right door opening process, first, it is determined whether a signal of the switch is ON (for example, high signal) (S31). When the signal of the switch is ON, it means that the central gear is located on the right side of the initialization position in the door closing interval of FIG. 13. Thus, clockwise driving of the motor starts (S32) and whether the switch is turned off is determined (S34). If it is determined that the switch is OFF, it means that a right door opening interval is immediately before termination. Then, the clockwise driving of the motor is maintained during a set time (approximately 1 second), and thereafter, the clockwise driving of the motor is stopped.

When the signal of the switch is OFF, it means that the central gear is located on the left side of the initialization position in the door closing interval of FIG. 13. Therefore, the motor is driven in the clockwise direction (S33) to check whether the switch signal is turned on (S35). ON of the switch means that the central gear is moved to the initialization position. Thereafter, it is checked that the switch is off (S34), and thereafter, clockwise driving of the motor is stopped similarly.

When opening of the right door is terminated, the step S40 of returning to the initial position of the right rack is performed. The motor rotates in the counterclockwise direction, and determining whether the switch is ON (S42) and determining whether the switch is OFF (S43) are sequentially performed, the right rack is completely returned. Also, a step (S50 of opening the left door is continuously performed. That is, counterclockwise rotation of the motor continues and the left door is opened.

The opening of the left door may be performed until the switch is checked to be ON (S51), and thereafter, the counterclockwise rotation of the motor is stopped for a set time.

When the opening of the left door is terminated, the left rack is returned (S60). After the counterclockwise rotation of the motor is stopped, the motor rotates in the clockwise direction to sequentially perform OFF confirmation (S62) and ON confirmation (S63) of the switch to stop driving the motor (S64), and thus, the door opening process is terminated (S70).

As described above, even when the central gear is not exactly at the initial position in the door closing interval, a normal door opening process may be performed. Also, the central gear may be returned to the accurate initial position through the door opening termination.

Thus, the frequency with which the initialization process is performed is very small. This prevents switching from occurring unnecessarily in the switch. The reason is because switching does not occur to open the door. In the initialization process.

The initialization process may be performed in the door opening interval illustrated in FIG. 13. In this case, the door is not opened in a normal process but power of the refrigerator is applied in a state that the door is opened.

Therefore, the controller cannot check which rack is in which position currently. Here, the initialization process illustrated in FIG. 23 is performed.

When power of the refrigerator is applied, the initialization process starts (S80). When it is determined that the door of the refrigerator is opened (S81), the initial position search process is performed (S100).

The initial position search process S100 may be a process of searching for an initial position through a change in a switch signal, while forwardly and reversely rotating the central gear by forwardly and reversely rotating the motor.

As illustrated in FIG. 13, the number of changes of the switch signal is 3 while the central gear rotates by 180 degrees in the clockwise or counterclockwise direction. Therefore, the initial position may be searched through the number of changes of the switch signal. That is, it is possible to return the central gear to the initial position and then perform a normal process.

When the number of changes of the switch is checked to be 1 (S82), it can be considered that the initial position is normally searched in the door closing interval illustrated in FIG. 13. Thus, the initialization process is then terminated.

When the number of changes of the switch is checked to be 3 (S83), the initial position search logic S100 is performed again.

If the number of changes of the switch is not 1 or 3, it can be considered that the initialization process has proceeded to a position close to the initial position.

It is determined that the switch is currently ON (S84).

When the switch is ON, the motor is driven in the counterclockwise direction (S86), it is determined that the switch is OFF (S88), and the initialization process is terminated. In this case, it can be considered that a reference point of the central gear is located in an interval (e-b) illustrated in FIG. 13.

If the switch is OFF, the motor is driven in the clockwise direction (S85), it is determined that the switch is ON (S87), and the initialization process is terminated. In this case, it can be considered that the reference point of the central gear is located in an interval (5-2) illustrated in FIG. 13.

Hereinafter, the initial position search process will be described with reference to FIG. 24.

The initial position search process is a process for searching where the current initial position is. That is, through the number of changes of switching by the forward and reverse driving of the motor, it is intended to search in which of the intervals illustrated in FIG. 13 the reference point of the central gear is present. For example, when the number of changes of switching is 1 and 2, the reference point position of the central gear may be easily searched and located at the initial position as described above.

When the number of changes of the switch is 3, it may be considered that the reference point of the central gear is located in one of x, y, w, and z intervals illustrated in FIG. 13. In this case, the initial position search process should be re-executed to set the reference point of the central gear to a different position. Since the rotation speed of the motor is constant, the x, y, w, and z intervals also appear as time intervals.

The initial position search process is performed by checking whether the switch is ON/OFF (S101). If the switch is ON, it is assumed that the current reference point is in the x, w interval and the motor is driven in the clockwise direction. Here, the change of the switch is checked (S103) and the number of changes is accumulated (S104). This process is performed for a predetermined time ($x+\alpha$) (S105). Here, a is set to a time shorter than the x, y, w, and z time intervals. Also, the motor is driven in the counterclockwise direction (S106) to check the change of the switch (S107) and the number of changes is increased (S108). This is performed for a predetermined time ($x+w+\alpha$).

If the number of changes of the switch is 1, it may be determined that the reference point is in the door closing interval, and if the number of changes of the switch is 2, it may be determined that the reference point is in a 2-b interval illustrated in FIG. 13.

If the number of changes of the switch is 3, the initial position search process restarts. When this process is repeated, the reference point at the time of starting the initial position search process is changed. Therefore, the reference point in the x, y, w, and z intervals is gradually moved to another interval. When the position of the reference point is outside the x, y, w, and z intervals, the number of changes of the switch is 1 or 2, so that the initialization process illustrated in FIG. 23 may be normally performed and terminated, without repeating the initial position search process any further.

The above-described embodiments may be implemented in combination with each other unless they are contradictory or exclusive.

According to the embodiment of the present invention, the refrigerator which increases user convenience by increasing the angle at which the door is automatically opened may be provided, and therefore, industrial applicability of the refrigerator is remarkable.

The invention claimed is:

1. A refrigerator comprising:

a cabinet that defines a storage compartment;

a first door configured to open and close a first side of the storage compartment;

a second door configured to open and close a second side of the storage compartment;

a door opening module comprising a motor that is configured to open the first and second doors and that is configured to rotate in a first direction and a second direction opposite to the first direction; and a controller configured to control rotation of the motor, wherein the door opening module further comprises:

a first rack configured to move toward the first door to open the first door based on rotation of the motor, a second rack configured to move toward the second door to open the second door based on rotation of the motor, a power transfer device configured to selectively transfer a driving force from the motor to at least one of the first rack or the second rack, the power transfer device comprising a central gear configured to be rotated based on driving of the motor, and a cam configured to rotate about a rotation center of the central gear, and a switch configured to be turned on and off based on rotation of the cam, wherein the controller is further configured to:

recognize a rack position of each of the first rack and the second rack based on a state of the switch, and based on the rack position of each of the first rack and the second rack, control the motor to rotate in the first direction and then rotate in the second direction such that the first and the second doors are sequentially opened, wherein the cam has a first side shape and a second side shape that are different from each other with respect to a reference position at which the cam contacts the switch, and wherein the switch is configure to:

based on the cam rotating from the reference position to a position corresponding to 180° with respect to the reference position in a clockwise direction, change ON-OFF states of the switch according to a first sequence that is defined by the first side shape of the cam, and based on the cam rotating from the reference position to the position corresponding to 180° in a counterclockwise direction, change the ON-OFF states of the switch according to a second sequence that is defined by the second side shape of the cam, the second sequence being different from the first sequence.

2. The refrigerator of claim 1, wherein the power transfer device further comprises:

a first intermittent gear disposed at a first side of the central gear; and a second intermittent gear disposed at a second side of the central gear, and wherein each of the first and second intermittent gears is configured to selectively engage with the central gear.

3. The refrigerator of claim 2, wherein the central gear is configured to:

in a first state in which both the first and second racks are drawn toward the cabinet, engage with the first intermittent gear based on rotating in a first rotation direction; and in the first state, engage with the second intermittent gear based on rotating in a second rotation direction.

4. The refrigerator of claim 2, wherein the switch is disposed at the first side of the central gear and extends away from the second side of the central gear.

5. The refrigerator of claim 3, wherein the central gear is configured to:

in the first state, engage with the second intermittent gear and disengage with the first intermittent gear based on rotating by a first rotation range that is less than 180° in a clockwise direction of the central gear.

6. The refrigerator of claim 5, wherein the central gear is configured to:

in the first state, engage with the first intermittent gear and disengage with the second intermittent gear based on rotating by a second rotation range that is less than 180° in a counterclockwise direction of the central gear.

7. The refrigerator of claim 1, wherein the cam has an inversion-symmetrical shape that is asymmetric with respect to a point corresponding to the reference position of the cam.

8. The refrigerator of claim 7, wherein:

the switch is configured to change through an ON state, an OFF state, and the ON state based on the cam rotating from the reference position to a position corresponding to 180° in a clockwise direction; and the switch is configured to change through the OFF state, the ON state, and the OFF state based on the cam rotating from the reference position to a position corresponding to 180° in a counterclockwise direction.

9. The refrigerator of claim 8, wherein the controller is configured to:

recognize a position of each of the first rack and the second rack based on a change in the ON state and the OFF state of the switch; and control driving of the motor based on the position of each of the first rack and the second rack.

10. The refrigerator of claim 9, wherein the controller is configured to, based on driving of the motor, sequentially move the first rack and the second rack.

11. The refrigerator of claim 10, wherein the controller is configured to, based on driving the motor, cause any one of the first and second racks to move outward and return toward the cabinet, and then cause the other one of the first and second racks to move outward and return toward the cabinet.

12. The refrigerator of claim 1, wherein the power transfer device is configured to transfer the driving force from the motor to at least one of the first rack or the second rack based on a plurality of movement ranges, and wherein the plurality of movement ranges comprise a constant speed range in which the at least one of the first rack or the second rack moves from an initial position at a constant speed, and an accelerated speed range in which the at least one of the first rack or the second rack moves at a speed increased from the constant speed after the constant speed range.

13. The refrigerator of claim 12, wherein the power transfer device includes a reduction gear and a rack gear that is defined at each of the first rack and the second rack and that is configured to engage with the reduction gear.

14. The refrigerator of claim 13, wherein the reduction gear includes:

a plurality of constant speed gear teeth having a predetermined radius from a rotation center of the reduction gear, and a plurality of acceleration gear teeth having a radius that increases from the rotation center of the reduction gear, and wherein the rack gear includes:

a plurality of linear gear teeth configured to engage with the plurality of constant speed gear teeth, and a plurality of diagonal gear teeth configured to engage with the plurality of accelerated gear teeth.

15. The refrigerator of claim 1, wherein the switch is configure to:

based on the cam rotating from the reference position to the position corresponding to 180° in the clockwise direction, change from an OFF state to an ON state and then change from the ON state to the OFF state according to the first sequence; and based on the cam rotating from the reference position to the position corresponding to 180° in the counterclockwise direction, change from the ON state to the OFF state and then change from the OFF state to the ON state according to the second sequence.

16. The refrigerator of claim 15, wherein each of the first side shape and the second side shape of the cam defines one or more ON intervals of the ON state and one or more OFF intervals of the OFF state, wherein a number of the one or more ON intervals defined at the second side shape of the cam is different from a number of the one or more ON intervals defined at the first side shape of the cam, and wherein a number of the one or more OFF intervals defined at the second side shape of the cam is different from a number of the one or more OFF intervals defined at the first side shape of the cam.

17. The refrigerator of claim 16, wherein a period of time of the one or more ON intervals defined at the second side shape of the cam is different from a period of time of the one or more ON intervals defined at the first side shape of the cam, and wherein a period of time of the one or more OFF intervals defined at the second side shape of the cam is different from a period of time of the one or more OFF intervals defined at the first side shape of the cam.

* * * * *